US010941766B2

(12) United States Patent
Hurst et al.

(10) Patent No.: US 10,941,766 B2
(45) Date of Patent: Mar. 9, 2021

(54) MULTI-LAYER COATING FOR PLUNGER AND/OR PACKING SLEEVE

(71) Applicant: Halliburton Energy Services, Inc., Houston, TX (US)

(72) Inventors: Justin Lee Hurst, Healdton, OK (US); David Mark Stribling, Duncan, OK (US); Ryan Heath Spoering, Duncan, OK (US)

(73) Assignee: Halliburton Energy Sendees, Inc., Houston, TX (US)

( * ) Notice: Subject to any disclaimer, the term of this patent is extended or adjusted under 35 U.S.C. 154(b) by 0 days.

(21) Appl. No.: 16/436,389

(22) Filed: Jun. 10, 2019

(65) Prior Publication Data

US 2020/0386223 A1 Dec. 10, 2020

(51) Int. Cl.

| | |
|---|---|
| ***F04B 53/16*** | (2006.01) |
| ***E21B 37/06*** | (2006.01) |
| ***E21B 23/08*** | (2006.01) |
| ***E21B 4/18*** | (2006.01) |

(52) U.S. Cl.

CPC ..... *F04B 53/166* (2013.01); *E21B 4/18* (2013.01); *E21B 23/08* (2013.01); *E21B 37/06* (2013.01)

(58) Field of Classification Search

CPC ..... F04B 53/166; E21B 4/18; E21B 23/08; E21B 37/06; E21B 12/02

See application file for complete search history.

(56) References Cited

U.S. PATENT DOCUMENTS

| | | | |
|---|---|---|---|
| 3,299,417 | A | 1/1967 | Sibthorpe |
| 3,459,363 | A | 8/1969 | Miller |
| 3,516,434 | A | 6/1970 | Noss |

(Continued)

FOREIGN PATENT DOCUMENTS

| | | | |
|---|---|---|---|
| EP | 0580196 | A1 | 1/1994 |
| WO | 2011103551 | A1 | 8/2011 |

OTHER PUBLICATIONS

Filing Receipt and Specification for patent application entitled "Flexible Manifold for Reciprocating Pump," by Joseph A. Beisel, et al., filed Oct. 7, 2019 as U.S. Appl. No. 16/594,825.

(Continued)

*Primary Examiner* — Aaron L Lembo

(74) *Attorney, Agent, or Firm* — Conley Rose, P.C.; Rodney B. Carroll

(57) ABSTRACT

A pump fluid end comprising: a reciprocating element disposed within a reciprocating element bore and having an outer surface; a reciprocating element packing positioned within the reciprocating element bore; and optionally a sleeve positioned within the reciprocating element bore and having an inner surface proximate the outer surface of the reciprocating element, wherein at least a portion of the outer surface of the reciprocating element and/or the inner surface of the sleeve is coated with a multi-layer surface coating comprising a plurality of layers including: a first layer in contact with the at least a portion of the outer surface of the reciprocating element and/or the inner surface of the sleeve; and a second layer disposed over at least a portion of the first layer; and wherein at least one of the plurality of layers has a different visual appearance and/or material composition than another of the plurality of layers.

22 Claims, 8 Drawing Sheets

(56) References Cited

U.S. PATENT DOCUMENTS 3,664,371 A 5/1972 Schneider
3,911,891 A * 10/1975 Dowell ..... C23C 4/11 123/669
3,976,809 A * 8/1976 Dowell ..... B24C 11/00 427/454
4,077,637 A * 3/1978 Hyde ..... F16J 9/26 277/444
4,341,235 A 7/1982 Nord
4,477,237 A 10/1984 Grable
4,692,305 A * 9/1987 Rangaswamy ..... C23C 4/067 148/403
4,784,588 A 11/1988 Miyashita et al.
4,850,392 A 7/1989 Crump et al.
4,939,923 A 7/1990 Sharp
5,040,408 A 8/1991 Webb
5,072,622 A 12/1991 Roach et al.
5,176,025 A 1/1993 Butts
5,343,738 A 9/1994 Skaggs
5,380,564 A * 1/1995 VanKuiken, Jr. ..... C23C 4/02 427/328
5,403,168 A 4/1995 Evenson
5,720,325 A 2/1998 Grantham
5,924,853 A 7/1999 Pacht
6,032,699 A 3/2000 Cochran et al.
6,082,392 A 7/2000 Watkins, Jr.
6,164,188 A 12/2000 Miser
6,342,272 B1 1/2002 Halliwell
6,607,010 B1 8/2003 Kashy
6,923,273 B2 * 8/2005 Terry ..... E21B 17/206 175/45
6,935,161 B2 8/2005 Hutchinson
7,138,043 B2 * 11/2006 Meyer ..... C22C 38/002 205/255
7,291,384 B2 * 11/2007 Obara ..... C23C 4/06 427/455
7,521,097 B2 * 4/2009 Horne ..... C23C 18/06 427/585
7,798,165 B2 9/2010 McClung, Jr.
8,033,550 B2 * 10/2011 Jacquet ..... C23C 28/046 277/442
8,234,911 B2 8/2012 Jax
8,366,408 B2 2/2013 Wago et al.
8,418,363 B2 4/2013 Patel
8,418,744 B2 * 4/2013 Balasubramanian ... B22C 9/061 164/72
8,506,262 B2 8/2013 Leugemors et al.
8,550,102 B2 10/2013 Small
8,590,614 B2 11/2013 Surjaatmadja et al.
8,893,807 B2 * 11/2014 Tait ..... E21B 41/00 166/382
9,499,895 B2 11/2016 Langan et al.
9,528,508 B2 12/2016 Thomeer et al.
9,617,654 B2 4/2017 Rajagopalan et al.
9,745,844 B2 * 8/2017 Aniket ..... E21B 41/0092
9,822,894 B2 11/2017 Bayyouk et al.
10,030,773 B2 * 7/2018 Stong ..... C23C 28/42
10,060,099 B2 * 8/2018 Serrurier ..... E02F 9/2883
10,240,238 B2 * 3/2019 Croopnick ..... C23C 24/04
10,428,945 B2 * 10/2019 Smith ..... B23P 15/06
10,458,505 B2 * 10/2019 Iseki ..... C22C 19/03
2002/0073840 A1 6/2002 Pippert
2003/0215644 A1 * 11/2003 Deshpande ..... C23C 26/00 428/416
2007/0044848 A1 3/2007 Norman
2007/0267076 A1 11/2007 Strauss et al.
2008/0011057 A1 1/2008 Spaolonzi et al.
2008/0057298 A1 * 3/2008 Finley ..... A61L 29/085 428/327
2009/0041588 A1 2/2009 Hunter et al.
2009/0041596 A1 2/2009 Ponomarev et al.
2009/0159133 A1 6/2009 Popke et al.
2009/0194174 A1 8/2009 Morgan et al.
2009/0278069 A1 11/2009 Blanco et al.
2010/0098568 A1 4/2010 Marica
2010/0126250 A1 5/2010 Jax
2010/0127462 A1 * 5/2010 Buchmann ..... C23C 4/02 277/444
2010/0304084 A1 * 12/2010 Anand ..... C23C 4/18 428/141
2010/0304181 A1 * 12/2010 Anand ..... C23C 28/34 428/627
2011/0023726 A1 * 2/2011 Nesbitt ..... A61L 31/16 99/443 C
2011/0180740 A1 7/2011 Marica
2011/0200838 A1 * 8/2011 Thomas ..... C22C 19/055 428/548
2012/0148431 A1 6/2012 Gabriel
2012/0223267 A1 9/2012 Marica
2012/0234539 A1 9/2012 Brunet et al.
2012/0279721 A1 11/2012 Surjaatmadja et al.
2012/0312402 A1 12/2012 Tyler
2013/0061942 A1 3/2013 Hulsey
2013/0319220 A1 12/2013 Lahuraka et al.
2014/0064996 A1 3/2014 Arima
2014/0150889 A1 6/2014 Ragner
2014/0261790 A1 9/2014 Marica
2014/0312257 A1 10/2014 Marica
2014/0328701 A1 11/2014 Nathan
2014/0348677 A1 11/2014 Moeller et al.
2015/0132157 A1 5/2015 Whaley et al.
2015/0322559 A1 * 11/2015 Killian ..... B05D 5/08 428/380
2016/0131264 A1 5/2016 Bregazzi et al.
2016/0215588 A1 7/2016 Belshan et al.
2016/0351973 A1 * 12/2016 Albano ..... H01M 10/0525
2017/0044653 A1 * 2/2017 Pollitt ..... B29C 70/545
2018/0058431 A1 3/2018 Blume
2018/0058444 A1 3/2018 Blume
2018/0298894 A1 10/2018 Wagner et al.
2018/0347696 A1 * 12/2018 Lima Sarabanda ..... F16J 9/26
2019/0093768 A1 * 3/2019 Lima Sarabanda ..... C23C 14/0641
2019/0120389 A1 4/2019 Foster et al.
2019/0226475 A1 7/2019 Stark et al.
2019/0368023 A1 * 12/2019 Klimek ..... C22C 38/40
2020/0182114 A1 * 6/2020 Koszewnik ..... F01N 13/001
2020/0208680 A1 * 7/2020 Adam ..... F16C 33/125
2020/0224317 A1 * 7/2020 Buchmann ..... C23C 4/18

OTHER PUBLICATIONS

Office Action (Restriction Requirement) dated Aug. 28, 2019, (7 pages), U.S. Appl. No. 16/522,874, filed Jul. 26, 2019.
Office Action (Restriction Requirement) dated Aug. 30, 2019, (5 pages), U.S. Appl. No. 16/436,356, filed Jun. 10, 2019.
Office Action dated Oct. 22, 2019 (27 pages), U.S. Appl. No. 16/522,874, filed Jul. 26, 2019.
Office Action dated Oct. 31, 2019 (21 pages), U.S. Appl. No. 16/436,356, filed Jun. 10, 2019.
Scully Intellicheck2, Complete Overfill Prevention and Retained Product Monitoring System, 67293 Rev B, Oct. 2013, 2 pages.
Scully Intellicheck2, Complete Overfill Prevention and Retained Product Monitoring System, 67293 Rev B, May 2014, 2 pages.
Scully Intellicheck3, Complete Overfill Prevention and Retained Product Monitoring System, XXXXX Rev A, Jun. 2016, 2 pages.
Foreign Communication from Related Application—International Search Report and Written Opinion of the International Searching Authority, International Application No. PCT/US2019/036785, dated Mar. 5, 2020, 13 pages.
Filing receipt and specification for patent application entitled "Pump Fluid End with Easy Access Suction Valve," by Justin L. Hurst, et al., filed May 14, 2019 as U.S. Appl. No. 16/411,891.
Filing receipt and specification for patent application entitled "Easy Change Pump Plunger," by Justin L. Hurst, et al., filed May 14, 2019 as U.S. Appl. No. 16/411,894.
Filing receipt and specification for patent application entitled "Pump Valve Seat with Supplemental Retention," by Justin L. Hurst, et al., filed May 14, 2019 as U.S. Appl. No. 16/411,898.
Filing receipt and specification for patent application entitled "Flexible Manifold for Reciprocating Pump," by Joseph A. Beisel, et al., filed May 14, 2019 as U.S. Appl. No. 16/411,901.

(56) References Cited

OTHER PUBLICATIONS

Filing receipt and specification for patent application entitled "Valve Assembly for a Fluid End with Limited Access," by Justin L. Hurst, et al., filed May 14, 2019 as U.S. Appl. No. 16/411,910.
Filing receipt and specification for patent application entitled "Pump Plunger with Wrench Features," by Justin L. Hurst, et al., filed May 14, 2019 as U.S. Appl. No. 16/411,905.
Filing receipt and specification for patent application entitled "Pump Fluid End with Suction Valve Closure Assist," by Justin L. Hurst, et al., filed Jun. 10, 2019 as U.S. Appl. No. 16/436,312.
Filing receipt and specification for patent application entitled "Multi-Material Frac Valve Poppet," by Jim B. Surjaatmadja, et al., filed Jun. 10, 2019 as U.S. Appl. No. 16/436,356.
Acknowledgement receipt and specification for International application entitled "Multi-Layer Coating for Plunger and/or Packing Sleeve," by Justin L. Hurst, et al., filed Jun. 12, 2019 as International application No. PCT/US2019/036785.
Filing receipt and specification for patent application entitled "Pump Fluid End with Positional Indifference for Maintenance," by Justin L. Hurst, et al., filed May 14, 2019 as U.S. Appl. No. 16/411,911.
Acknowledgement receipt and specification for patent application entitled, "Oil Field Pumps with Reduced Maintenance," by Jim B. Surjaatmadja, et al., filed Jul. 26, 2019 as U.S. Appl. No. 16/522,860.
Acknowledgement receipt and specification for patent application entitled, "Fail Safe Suction Hose for Significantly Moving Suction Port," by Jim B. Surjaatmadja, et al., filed Jul. 26, 2019 as U.S. Appl. No. 16/522,874.
Acknowledgement receipt and specification for International application entitled "Oil Field Pumps with Reduced Maintenance," by Jim B. Surjaatmadja, et al., filed Jul. 30, 2019 as International application No. PCT/US2019/044191.
Acknowledgement receipt and specification for International application entitled "Fail Safe Suction Hose for Significantly Moving Suction Port," by Jim B. Surjaatmadja, et al., filed Jul. 30, 2019 as International application number PCT/US2019/044194.

* cited by examiner

MULTI-LAYER COATING FOR PLUNGER AND/OR PACKING SLEEVE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present disclosure relates generally to a method and apparatus for supplying pressurized fluids. More particularly, the present disclosure relates to methods and reciprocating devices for pumping fluids into a wellbore.

BACKGROUND

High-pressure pumps having reciprocating elements such as plungers or pistons are commonly employed in oil and gas production fields for operations such as drilling and well servicing. For instance, one or more reciprocating pumps may be employed to pump fluids into a wellbore in conjunction with activities including fracturing, acidizing, remediation, cementing, and other stimulation or servicing activities. Due to the harsh conditions associated with such activities, many considerations are generally taken into account when designing a pump for use in oil and gas operations. One design consideration may concern ease of maintenance, as reciprocating pumps used in wellbore operations, for example, often encounter high cyclical pressures and various other conditions that can render pump components susceptible to wear and result in a need for servicing and maintenance of the pump.

Accordingly, it is desirable to provide a pump fluid end comprising a multi-layer coating on one or more substrates, whereby the multi-layer coating facilitates determination of whether or not a reciprocating element packing needs maintenance.

BRIEF SUMMARY OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein is a reciprocating apparatus for pumping pressurized fluid. In embodiments, the reciprocating apparatus comprises a pump fluid end comprising: a cylindrical reciprocating element disposed at least partially within a cylindrical reciprocating element bore and having an outer surface; a reciprocating element packing positioned at a back of the pump fluid end within the reciprocating element bore; and optionally a cylindrical sleeve positioned within the reciprocating element bore such that the reciprocating element reciprocates within the sleeve and having an inner surface proximate the outer surface of the reciprocating element. According to this disclosure, at least a portion of the outer surface of the reciprocating element and/or at least a portion of the inner surface of the sleeve is coated with a multi-layer surface coating comprising a plurality of layers. The plurality of layers include a first layer in contact with the at least a portion of the outer surface of the reciprocating element and/or the at least a portion of the inner surface of the sleeve; and a second layer disposed over at least a portion of the first layer. According to this disclosure, at least one of the plurality of layers has a different visual appearance and/or material composition than at least one other of the plurality of layers. In embodiments, the reciprocating apparatus is a high-pressure pump configured to operate at a pressure greater than or equal to about 3,000 psi and/or in a well servicing operation and environment.

Figure 1:
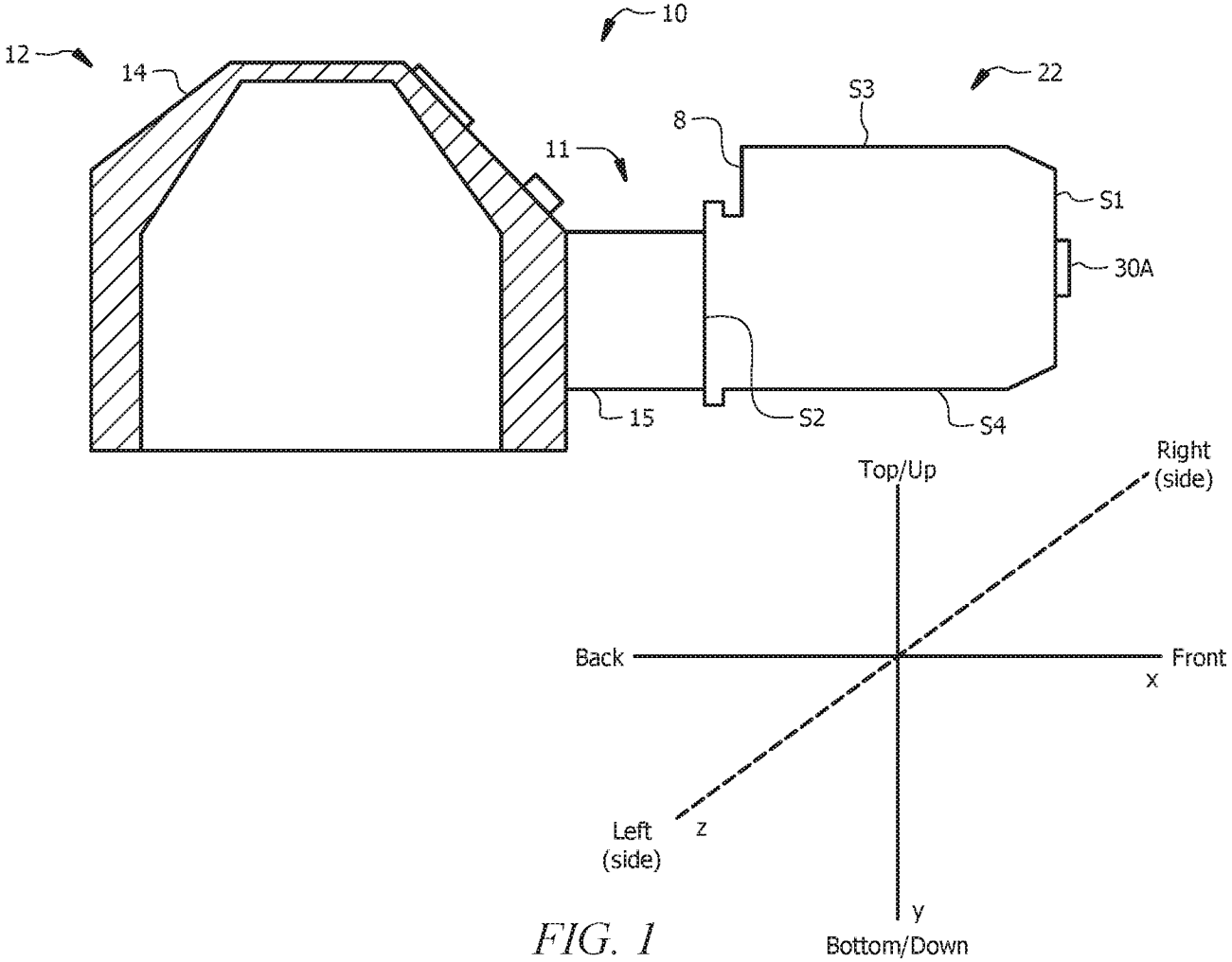
FIG. 1 is an elevational view of a reciprocating pump, according to embodiments of this disclosure.

A reciprocating apparatus of this disclosure may comprise any suitable pump operable to pump fluid. Non-limiting examples of suitable pumps include, but are not limited to, piston pumps, plunger pumps, and the like. In embodiments, the pump is a rotary- or reciprocating-type pump such as a positive displacement pump operable to displace pressurized fluid. The pump comprises a pump power end, a pump fluid end, and an integration section whereby a reciprocating element (e.g., a plunger) can be mechanically connected with the pump power end such that the reciprocating element can be reciprocated within a reciprocating element bore of the pump fluid end. FIG. 1 is an elevational view (e.g., side view) of a pump 10 (e.g., a reciprocating pump) according to an exemplary embodiment, the reciprocating pump comprising a pump power end 12, a pump fluid end 22, and an integration section 11. As illustrated in FIG. 1, pump fluid end has a front S1 opposite a back S2 along a first or x-axis, a top S3 opposite a bottom S4 along a second or y-axis, wherein the y-axis is in the same plane as and perpendicular to the x-axis, and a left side and a right side along a z-axis, wherein the z-axis is along a plane perpendicular to the plane of the x-axis and the y-axis. Accordingly, toward the top of pump fluid end 22 (and pump 10) is along the y-axis toward top S3, toward the bottom of pump fluid end 22 (and pump 10) is along the y-axis toward bottom S4, toward the front of pump fluid end 22 (and pump 10) is along the x-axis toward front S1, and toward the back of pump fluid end 22 (and pump 10) is along the x-axis away from front S1.

Figure 2A:
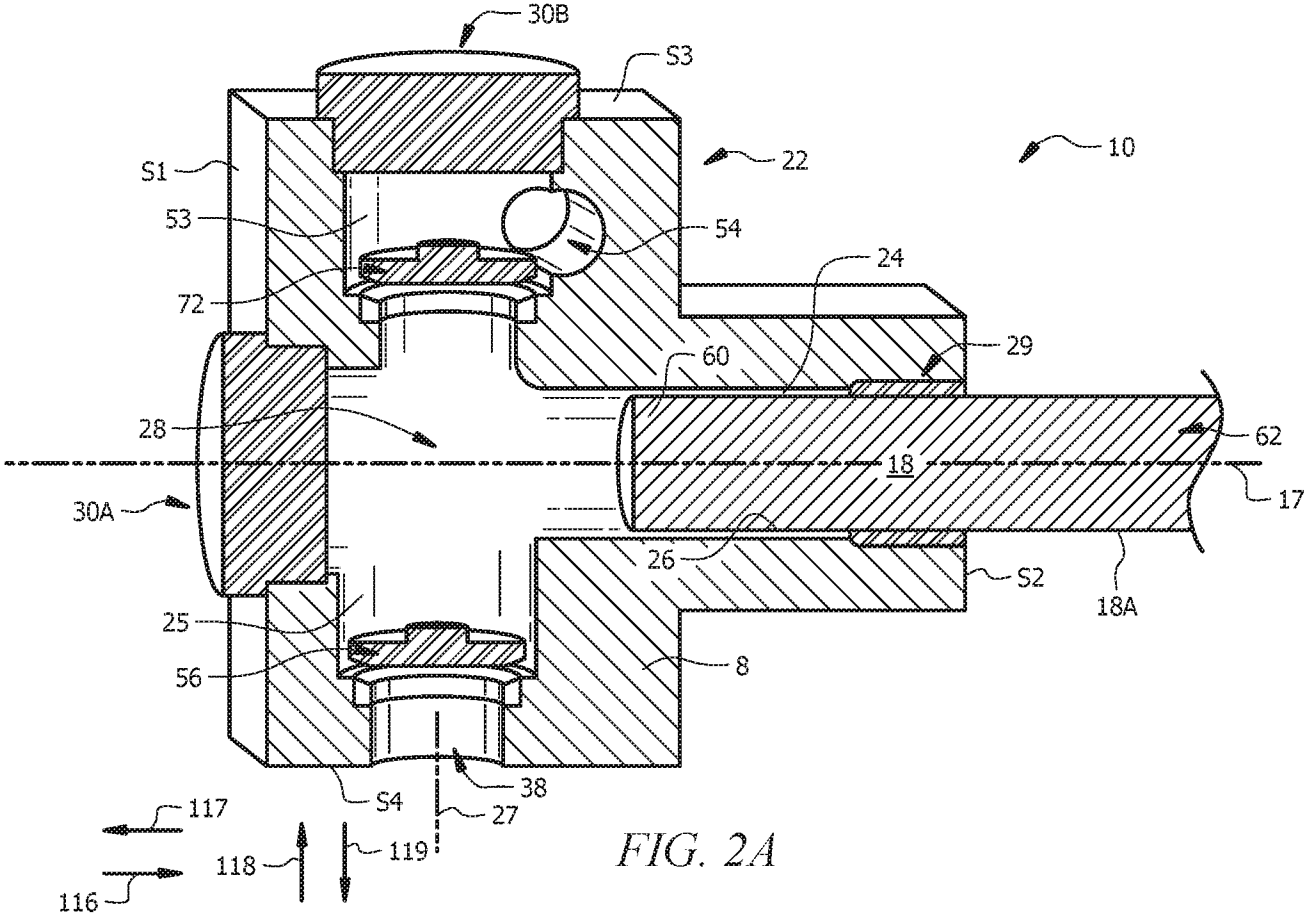
FIG. 2A is a cut-away illustration of an exemplary reciprocating pump comprising a cross-bore pump fluid end, according to embodiments of the present disclosure.
Figure 2B:
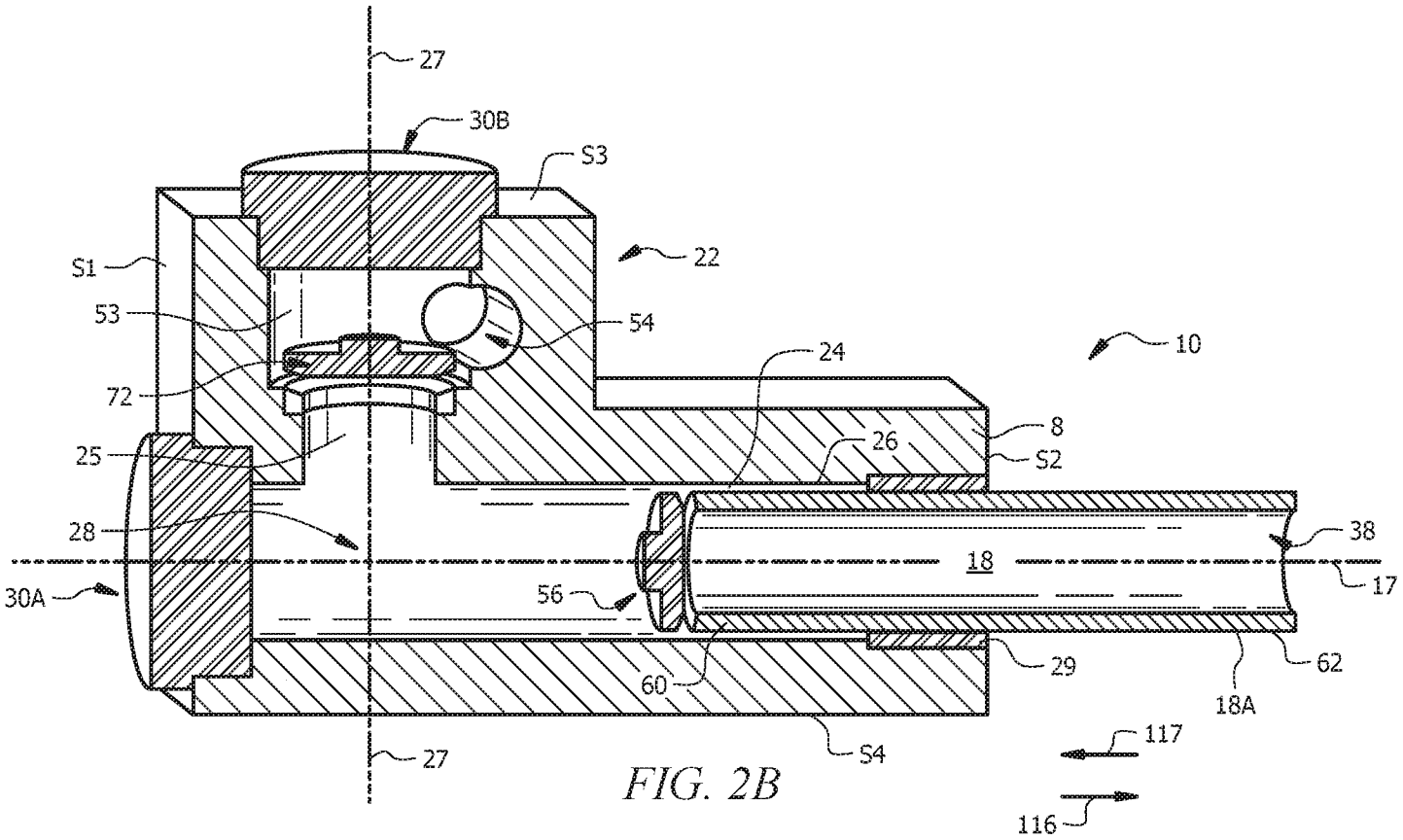
FIG. 2B is a cut-away illustration of an exemplary reciprocating pump comprising a cross-bore pump fluid end, according to other embodiments of the present disclosure.
Figure 3:
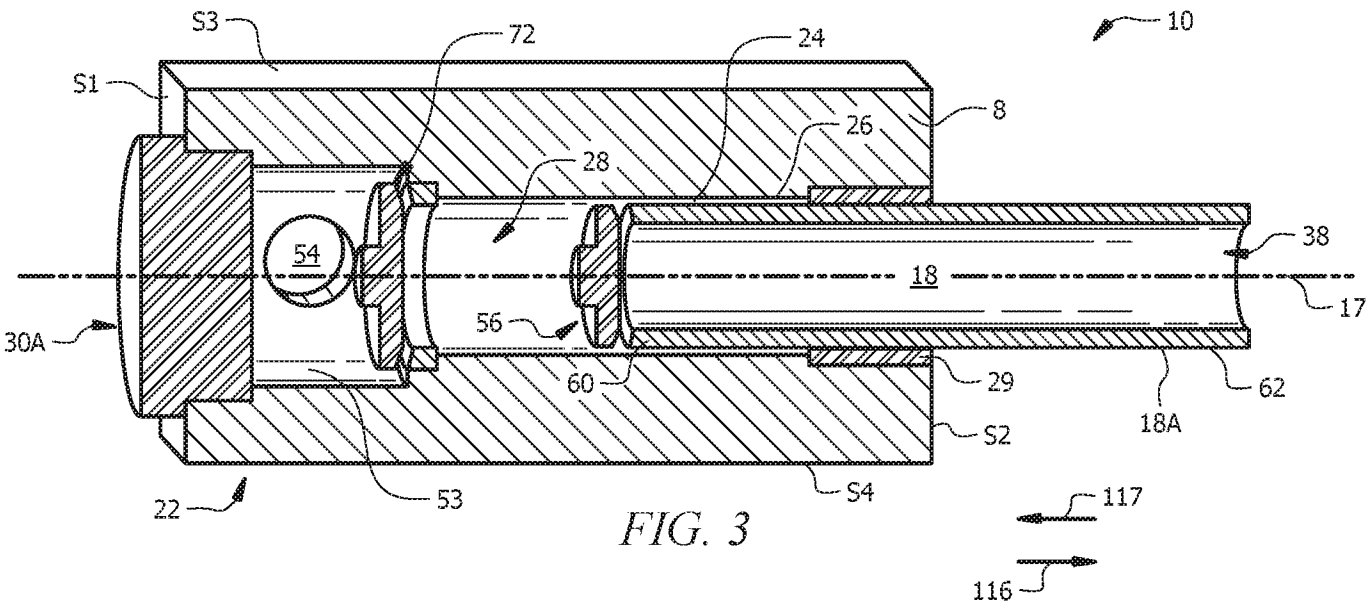
FIG. 3 is a cut-away illustration of an exemplary reciprocating pump comprising a concentric bore pump fluid end, according to embodiments of the present disclosure.

The pump fluid end 22 is integrated with the pump power end 12 via the integration section 11, such that pump power end 12 is operable to reciprocate the reciprocating element 18 within a reciprocating element bore 24 (FIGS. 2-3) of the pump fluid end 22. The reciprocating element bore 24 is at least partially defined by a cylinder wall 26. As described further hereinbelow with reference to FIGS. 2A-2B and FIG. 3, pump fluid end 22 can be a cross-bore pump fluid end 22 or, alternatively, an in-line or "concentric" bore pump fluid end. As utilized herein, cross-bore pump fluid ends can comprise "T-bore" pump fluid ends, "X-bore" (e.g., cross shaped bore) pump fluid ends, or "Y-bore" pump fluid ends. FIG. 2A is a schematic showing a cross-bore pump fluid end 22 engaged with a reciprocating element 18, wherein the cross-bore pump fluid end 22 comprises a cross-bore 25 that makes a cross shape (+) relative to reciprocating element bore 24. FIG. 2B is a schematic showing a cross-bore pump fluid end 22 engaged with a reciprocating element 18, wherein the cross bore pump fluid end 22 comprises a tee-bore 25 that makes a "T" shape relative to reciprocating element bore 24. FIG. 3 is a schematic showing a concentric bore pump fluid end 22 engaged with a reciprocating element 18. As discussed further below, the pump 10 includes at least one fluid inlet 38 for receiving fluid from a fluid source, e.g., a suction line, suction header, storage or mix tank, blender, discharge from a boost pump such as a centrifugal pump, etc. The pump 10 also includes at least one discharge outlet 54 for discharging fluid to a discharge source, e.g., a flowmeter, pressure monitoring and control system, distribution header, discharge line, wellhead, discharge manifold pipe, and the like.

The pump 10 may comprise any suitable pump power end 12 for enabling the pump 10 to perform pumping operations (e.g., pumping a wellbore servicing fluid downhole). Similarly, the pump 10 may include any suitable housing 14 for containing and/or supporting the pump power end 12 and components thereof. The housing 14 may comprise various combinations of inlets, outlets, channels, and the like for circulating and/or transferring fluid. Additionally, the housing 14 may include connections to other components and/or systems, such as, but not limited to, pipes, tanks, drive mechanisms, etc. Furthermore, the housing 14 may be configured with cover plates or entryways for permitting access to the pump power end 12 and/or other pump components. As such, the pump 10 may be inspected to determine whether parts need to be repaired or replaced. The pump power end may also be hydraulically driven, whether it is a non-intensifying or an intensifying system.

Figure 4:
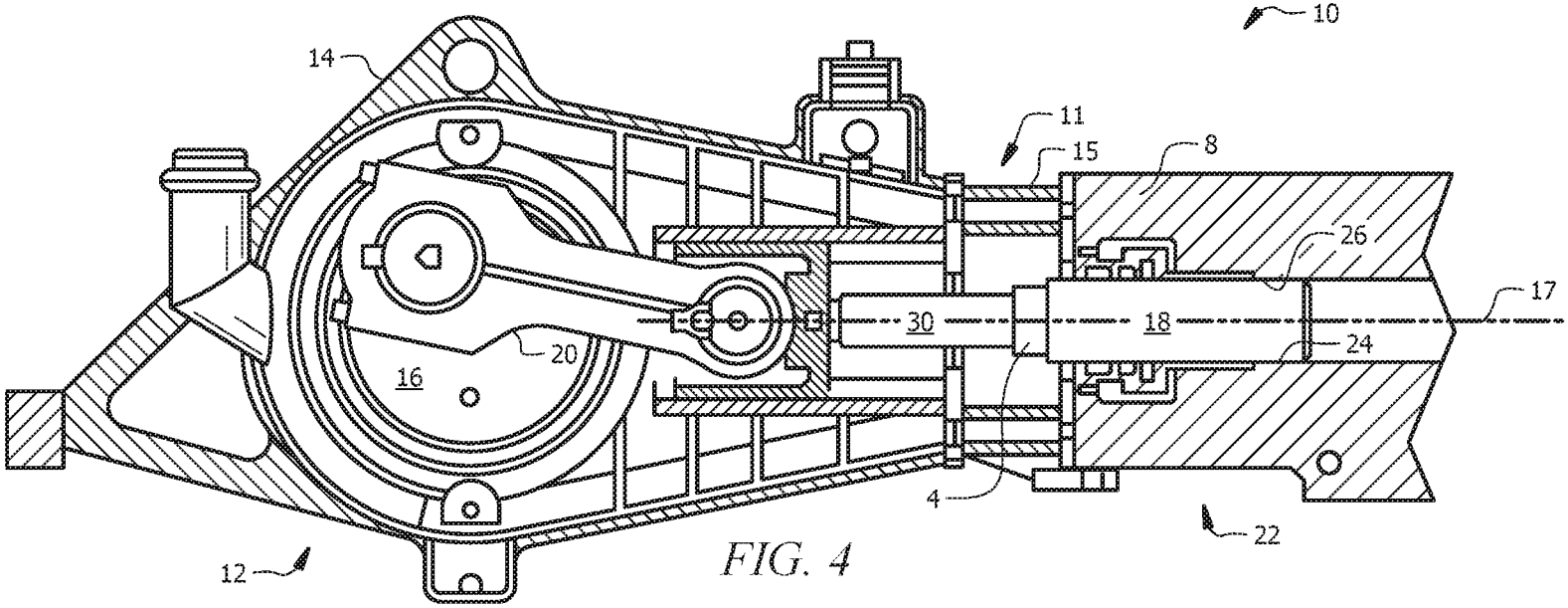
FIG. 4 is cut-away illustration of a pump power end of a pump, according to embodiments of the present disclosure.

Those versed in the art will understand that the pump power end 12 may include various components commonly employed in pumps. Pump power end 12 can be any suitable pump known in the art and with the help of this disclosure to be operable to reciprocate reciprocating element 18 in reciprocating element bore 24. For example, without limitation, pump power end 12 can be operable via and comprise a crank and slider mechanism, a powered hydraulic/pneumatic/steam cylinder mechanism or various electric, mechanical or electro-mechanical drives. FIG. 4 provides a cutaway illustration of an exemplary pump 10 of this disclosure, showing an exemplary pump power end 12, integrated via integration section 11 with a pump fluid end 22, wherein the pump power end 12 is operable to reciprocate the reciprocating element 18 within a reciprocating element bore 24 of the pump fluid end 22. Briefly, for example, the pump power end 12 may include a rotatable crankshaft 16 attached to at least one reciprocating element 18 (e.g., a plunger or piston) by way of a crank arm/connecting rod 20. Additionally, an engine (e.g., a diesel engine), motor, or other suitable power source may be operatively connected to the crankshaft 16 (e.g., through a transmission and drive shaft) and operable to actuate rotation thereof. In operation, rotation of the crankshaft 16 induces translational movement of the crank arm/connecting rod 20, thereby causing the reciprocating element 18 to extend and retract along a flow path, which may generally be defined by a central axis 17 within a reciprocating element bore 24 (sometimes referred to herein for brevity as a "reciprocating element bore 24" or simply a "bore 24", and wishing to be limited to a particular reciprocating element 18). Pump 10 of FIG. 1 is typically mounted on a movable structure such as a semi-tractor trailer or skid, and the moveable structure may contain additional components, such as a motor or engine (e.g., a diesel engine), that provides power (e.g., mechanical motion) to the pump power end 12 (e.g., a crankcase comprising crankshaft 16 and related connecting rods 20).

Of course, numerous other components associated with the pump power end 12 of the pump 10 may be similarly employed, and therefore, fall within the purview of the present disclosure. Furthermore, since the construction and operation of components associated with pumps of the sort depicted in FIG. 1 are well known and understood, discussion of the pump 10 will herein be limited to the extent necessary for enabling a proper understanding of the disclosed embodiments.

As noted hereinabove, the pump 10 comprises a pump fluid end 22 attached to the pump power end 12. Various embodiments of the pump fluid end 22 are described in detail below in connection with other drawings, for example FIGS. 2A-2B and 3. Generally, the pump fluid end 22 comprises at least one fluid inlet 38 for receiving fluid, and at least one discharge outlet 54 through which fluid flows out of the discharge chamber 53. The pump fluid end 22 also comprises at least one valve assembly for controlling the receipt and output of fluid. For example, the pump fluid end 22 can comprise a suction valve assembly 56 and a discharge valve assembly 72. The pump fluid end 22 may include any suitable component(s) and/or structure(s) for containing and/or supporting the reciprocating element 18 and providing a cylinder wall 26 at least partially defining a reciprocating element bore 24 along which the pump power end can reciprocate the reciprocating element during operation of the pump.

In embodiments, the pump fluid end 22 may comprise a cylinder wall 26 at least partially defining a bore 24 through which the reciprocating element 18 may extend and retract. Additionally, the bore 24 may be in fluid communication with a discharge chamber 53 formed within the pump fluid end 22. Such a discharge chamber 53, for example, may be configured as a pressurized discharge chamber 53 having a discharge outlet 54 through which fluid is discharged by the reciprocating element 18. Thus, the reciprocating element 18 may be movably disposed within the reciprocating element bore 24, which may provide a fluid flow path into and/or out of the pump chamber. During operation of the pump 10, the reciprocating element 18 may be configured to reciprocate along a path (e.g., along central axis 17 within bore 24 and/or pump chamber 28, which corresponds to reciprocal movement parallel to the x-axis of FIG. 1) to transfer a supply of fluid to the pump chamber 28 and/or discharge fluid from the pump chamber 28.

In operation, the reciprocating element 18 extends and retracts along a flow path to alternate between providing forward strokes forward strokes (also referred to as discharge strokes and correlating to movement in a positive direction parallel to the x-axis of FIG. 1, indicated by arrow 117) and return strokes (also referred to as suction strokes and correlating to movement in a negative direction parallel to the x-axis of FIG. 1, indicated by arrow 116), respectively. During a forward stroke, the reciprocating element 18 extends away from the pump power end 12 and toward the pump fluid end 22. Before the forward stoke begins, the reciprocating element 18 is in a fully retracted position (also referred to as bottom dead center (BDC) with reference to the crankshaft 16), in which case the suction valve assembly 56 can be in a closed configuration having allowed fluid to flow into the (e.g., high pressure) pump chamber 28. (As utilized here, "high pressure" indicates possible subjection to high pressure during discharge.) When discharge valve assembly 72 is in a closed configuration (e.g., under the influence of a closing mechanism, such as a spring), the high pressure in a discharge pipe or manifold containing discharge outlet 54 prevents fluid flow into discharge chamber 53 and causes pressure in the pump chamber 28 to accumulate upon stroking of the reciprocating element 18. When the reciprocating element 18 begins the forward stroke, the pressure builds inside the pump chamber 28 and acts as an opening force that results in positioning of the discharge valve assembly 72 in an open configuration, while a closing force (e.g., via a closing mechanism, such as a spring and/or pressure increase inside pump chamber 28) urges the suction valve assembly 56 into a closed configuration. When utilized in connection with a valve assembly, 'open' and 'closed' refer, respectively, to a configuration in which fluid can flow through the valve assembly (e.g., can pass between a valve body (e.g., a movable poppet or poppet assembly) and a valve seat thereof) and a configuration in which fluid cannot flow through the valve assembly (e.g., cannot pass between a valve body (e.g., a movable poppet or poppet assembly) and a valve seat thereof). As the reciprocating element 18 extends forward, fluid within the pump chamber 28 is discharged through the discharge outlet 54.

During a return stroke, the reciprocating element 18 reciprocates or retracts away from the pump fluid end 22 and towards the pump power end 12 of the pump 10. Before the return stroke begins, the reciprocating element 18 is in a fully extended position (also referred to as top dead center (TDC) with reference to the crankshaft 16), in which case the discharge valve assembly 72 can be in a closed configuration having allowed fluid to flow out of the pump chamber 28 and the suction valve assembly 56 is in a closed configuration. When the reciprocating element 18 begins and retracts towards the pump power end 12, the discharge valve assembly 72 assumes a closed configuration, while the suction valve assembly 56 opens. As the reciprocating element 18 moves away from the discharge valve 72 during a return stroke, fluid flows through the suction valve assembly 56 and into the pump chamber 28.

With reference to the embodiments of FIG. 2A, which is a schematic showing a cross-bore pump fluid end 22 engaged with a reciprocating element 18, cross-bore pump fluid end 22 comprises a cross-bore fluid end body 8, a cross-bore pump chamber 28, a suction valve assembly 56, and a discharge valve assembly 72. In this cross-bore configuration, suction valve assembly 56 and discharge valve assembly 72 are located in a bore or channel 25 (also referred to herein as a cross bore 25) of pump chamber 28, wherein bore 25 has a central axis 27 that is parallel to the y-axis of FIG. 1 and is perpendicular to bore 24 in which reciprocating element 18 reciprocates during operation. Suction valve assembly 56 and discharge valve assembly 72 are operable to direct fluid flow within the pump 10. When reciprocating element 18 retracts, or moves along central axis 17 in a direction away from the pump chamber 28 and the pump fluid end 22 and toward the pump power end 12 (as indicated by arrow 116), a suction valve of the suction valve assembly 56 opens (e.g., either under natural flow or other biasing means), and a discharge valve of discharge valve assembly 72 will be closed, whereby fluid enters pump chamber 28 via fluid inlet 38. When the reciprocating element 18 reverses direction, due to the action of the pump power end 12, the reciprocating element 18 reverses direction along central axis 17, now moving in a direction toward the pump chamber 28 and pump fluid end 22 and away from pump power end 12 (as indicated by arrow 117), and the discharge valve of discharge valve assembly 72 is open and the suction valve of suction valve assembly 56 is closed (e.g., again either due to fluid flow and/or other biasing means of valve control), such that fluid is pumped out of pump chamber 28 via discharge outlet 54.

With reference to the embodiment of FIG. 2B, which is a schematic showing a T-bore pump fluid end 22 engaged with a reciprocating element 18, T-bore pump fluid end 22 comprises a T-bore fluid end body 8, a T-shaped pump chamber 28, a suction valve assembly 56, and a discharge valve assembly 72. In this T-bore configuration of FIG. 2B, suction valve assembly 56 is coupled with front end 60 of reciprocating element 18 and discharge valve assembly 72 is positioned in bore 25 that makes a tee with reciprocating element bore 24, i.e., central axis 17 of reciprocating element bore 24 is also the central axis of suction pump assembly 56 and perpendicular to a central axis 27 of discharge valve assembly 72 (i.e., central axis 27 is parallel to the y-axis of FIG. 1 and is perpendicular to bore 24 in which reciprocating element 18 reciprocates during operation). Suction valve assembly 56 and discharge valve assembly 72 are operable to direct fluid flow within the pump 10. When reciprocating element 18 retracts, or moves along central axis 17 in a direction away from the pump chamber 28 and the pump fluid end 22 and toward the pump power end 12 (as indicated by arrow 116), a suction valve of the suction valve assembly 56 opens (e.g., either under natural flow or other biasing means), and a discharge valve of discharge valve assembly 72 will be closed, whereby fluid enters pump chamber 28 via fluid inlet 38. When the reciprocating element 18 reverses direction, due to the action of the pump power end 12, the reciprocating element 18 reverses direction along central axis 17, now moving in a direction toward the pump chamber 28 and pump fluid end 22 and away from pump power end 12 (as indicated by arrow 117), and the discharge valve of discharge valve assembly 72 is open and the suction valve of suction valve assembly 56 is closed (e.g., again either due to fluid flow and/or other biasing means of valve control), such that fluid is pumped out of pump chamber 28 via discharge outlet 54.

With reference to the embodiment of FIG. 3, which is a schematic showing a concentric pump fluid end 22 engaged with a reciprocating element 18, concentric bore pump fluid end 22 comprises a concentric bore fluid end body 8, a concentric pump chamber 28, a suction valve assembly 56, and a discharge valve assembly 72. In this concentric bore configuration, suction valve assembly 56 and discharge valve assembly 72 are positioned in-line (also referred to as coaxial) with reciprocating element bore 24, i.e., central axis 17 of reciprocating element bore 24 is also the central axis of suction pump assembly 56 and discharge valve assembly 72). Suction valve assembly 56 and discharge valve assembly 72 are operable to direct fluid flow within the pump 10. In some concentric bore fluid end designs, fluid flows within a hollow reciprocating element (e.g., a hollow plunger) 18. In some such embodiments, the reciprocating element bore 24 of such a concentric bore fluid end design can be defined by a high pressure cylinder 26 providing a high pressure chamber and a low pressure cylinder (not depicted in the embodiment of FIG. 3) providing a low pressure chamber toward tail end 62 of reciprocating element 18, whereby fluid from fluid inlet 38 enters reciprocating element 18. When reciprocating element 18 retracts, or moves along central axis 17 in a direction away from the pump chamber 28 and pump fluid end 22 and toward pump power end 12 (as indicated by arrow 116), a suction valve of the suction valve assembly 56 opens (e.g., either under natural flow and/or other biasing means), and a discharge valve of discharge valve assembly 72 will be closed, whereby fluid enters pump chamber 28 via a fluid inlet 38. For a concentric bore pump fluid end 22 design, the fluid inlet can be configured to introduce fluid into pump chamber 28 via a reciprocating element 18 that is hollow and/or via a low pressure chamber as described above. When the reciprocating element 18 reverses direction, due to the action of the pump power end 12, the reciprocating element 18 reverses direction along central axis 17, now moving in a direction toward the pump chamber 28 and pump fluid end 22 and away from pump power end 12 (as indicated by arrow 117), and the discharge valve of discharge valve assembly 72 is open and the suction valve of suction valve assembly 56 is closed (e.g., again either due to fluid flow and/or other biasing means of valve control), such that fluid is pumped out of pump chamber 28 via discharge chamber 53 and discharge outlet 54.

A pump 10 of this disclosure can comprise one or more access ports. For example, with reference to the cross-bore fluid end body 8 embodiments of FIG. 2A and FIG. 2B, a front access port 30A can be located on a front S1 of the pump fluid end 22 opposite a back S2 of the pump fluid end 22, wherein the back S2 of the pump fluid end is proximal the pump power end 12, upon integration therewith via integration section 11. A top access port 30B can be located on a top S3 of the pump fluid end 22 opposite a bottom S4 of the pump fluid end 22, wherein the top S1 of the pump fluid end 22 is above central axis 17 and the bottom S4 of the pump fluid end 22 is below central axis 17. With reference to the concentric fluid end body 8 embodiment of FIG. 3, a front access port 30A can be located on a front S1 of the pump fluid end 22 opposite a back S2 of the pump fluid end 22, wherein the back S2 of the pump fluid end is proximal the pump power end 12, upon integration therewith via integration section 11. Locations described as front S1, back S2, top S3, and bottom S4 are further described with reference to the x-y-z coordinate system shown in FIG. 1 and further can be relative to a surface (e.g., a trailer bed, the ground, a platform, etc.) upon which the pump 10 is located, a bottom S4 of the pump fluid end being proximal the surface (e.g., trailer bed) upon which the pump 10 is located. Generally, due to size and positioning of pump 10, the front S1 and top S3 of the pump fluid end 22 are more easily accessible than a back S2 or bottom S4 thereof. In a similar manner, a front of pump 10 is distal the pump power end 12 and a back of the pump 10 is distal the pump fluid end 22. The integration section 11 can be positioned in a space between the pump fluid end 22 and the pump power end 12, and can be safeguarded (e.g., from personnel) via a cover 15.

In embodiments, a pump fluid end 22 and pump 10 of this disclosure comprise at least one access port located on a side of the discharge valve assembly 72 opposite the suction valve assembly 56. For example, in the cross-bore pump fluid end 22 embodiment of FIG. 2A, top access port 30B is located on a side (e.g., top side) of discharge valve assembly 72 opposite suction valve assembly 56, while in the concentric bore pump fluid end 22 embodiment of FIG. 3, front access port 30A is located on a side (e.g., front side) of discharge valve assembly 72 opposite suction valve assembly 56.

In embodiments, one or more seals 29 (e.g., "o-ring" seals, packing seals, or the like), also referred to herein as 'primary' reciprocating element packing 29 (or simply "packing 29") may be arranged around the reciprocating element 18 to provide sealing between the outer walls of the reciprocating element 18 and the inner walls 26 defining at least a portion of the reciprocating element bore 24. The inner walls 26 may be provided by fluid end body 8 or a sleeve 95 within reciprocating element bore 24, as described below with reference to FIG. 5 and FIGS. 6A-6B. In some concentric bore fluid end designs, a second set of seals (also referred to herein as 'secondary' reciprocating element packing; not shown in the Figures) may be fixedly arranged around the reciprocating element 18 to provide sealing between the outer walls of the reciprocating element 18 and the inner walls of a low-pressure cylinder that defines the low pressure chamber described hereinabove (e.g., wherein the secondary packing is farther back along the x-axis and delineates a back end of the low pressure chamber that extends from the primary packing 29 to the secondary packing). In embodiments, only a primary reciprocating element packing is utilized, as fluid enters tail end 62 of reciprocating element 18 without first contacting an outer peripheral wall thereof (i.e., no secondary reciprocating element packing is needed/utilized, because no low pressure chamber external to reciprocating element 18 is utilized). Skilled artisans will recognize that the seals may comprise any suitable type of seals, and the selection of seals may depend on various factors e.g., fluid, temperature, pressure, etc.

While the foregoing discussion focused on a pump fluid end 22 comprising a single reciprocating element 18 disposed in a single reciprocating element bore 24, it is to be understood that the pump fluid end 22 may include any suitable number of reciprocating elements. As discussed further below, for example, the pump 10 may comprise a plurality of reciprocating elements 18 and associated reciprocating element bores 24 arranged in parallel and spaced apart along the z-axis of FIG. 1 (or another arrangement such as a V block or radial arrangement). In such a multi-bore pump, each reciprocating element bore may be associated with a respective reciprocating element and crank arm, and a single common crankshaft may drive each of the plurality of reciprocating elements and crank arms. Alternatively, a multi-bore pump may include multiple crankshafts, such that each crankshaft may drive a corresponding reciprocating element. Furthermore, the pump 10 may be implemented as any suitable type of multi-bore pump. In a non-limiting example, the pump 10 may comprise a Triplex pump having three reciprocating elements 18 (e.g., plungers or pistons) and associated reciprocating element bores 24, discharge valve assemblies 72 and suction valve assemblies 56, or a Quintuplex pump having five reciprocating elements 18 and five associated reciprocating element bores 24, discharge valve assemblies 72 and suction valve assemblies 56.

Reciprocating element bore 24 can have an inner diameter slightly greater than the outer diameter of the reciprocating element 18, such that the reciprocating element 18 may sufficiently reciprocate within reciprocating element bore 24 (optionally, within a sleeve 95, as described hereinbelow). In embodiments, the fluid end body 8 of pump fluid end 22 has a pressure rating ranging from about 100 psi to about 3000 psi, or from about 2000 psi to about 10,000 psi, from about 5000 psi to about 30,000 psi, or from about 3000 psi to about 50,000 psi or greater. The fluid end body 8 of pump fluid end 22 may be cast, forged or formed from any suitable materials, e.g., steel, metal alloys, or the like. Those versed in the art will recognize that the type and condition of material(s) suitable for the fluid end body 8 may be selected based on various factors. In a wellbore servicing operation, for example, the selection of a material may depend on flow rates, pressure rates, wellbore service fluid types (e.g., particulate type and/or concentration present in particle laden fluids such as fracturing fluids or drilling fluids, or fluids comprising cryogenic/foams), etc. Moreover, the fluid end body 8 (e.g., cylinder wall 26 defining at least a portion of reciprocating element bore 24 and/or pump chamber 28) may include protective coatings for preventing and/or resisting abrasion, erosion, and/or corrosion.

In embodiments, the cylindrical shape (e.g., providing cylindrical wall(s) 26) of the fluid end body 8 may be pre-stressed in an initial compression. Moreover, a high-pressure cylinder(s) providing the cylindrical shape (e.g., providing cylindrical wall(s) 26) may comprise one or more sleeves (e.g., heat-shrinkable sleeves). Additionally or alternatively, the high-pressure cylinder(s) may comprise one or more composite overwraps and/or concentric sleeves ("over-sleeves"), such that an outer wrap/sleeve pre-loads an inner wrap/sleeve. The overwraps and/or over-sleeves may be non-metallic (e.g., fiber windings) and/or constructed from relatively lightweight materials. Overwraps and/or over-sleeves may be added to increase fatigue strength and overall reinforcement of the components.

The cylinders and cylindrical-shaped components (e.g., providing cylindrical wall 26) associated with the pump fluid end body 8 of pump fluid end 22 may be held in place within the pump 10 using any appropriate technique. For example, components may be assembled and connected, e.g., bolted, welded, etc. Additionally or alternatively, cylinders may be press-fit (e.g., interference fit) into openings machined or cast into the pump fluid end 22 or other suitable portion of the pump 10. Such openings may be configured to accept and rigidly hold cylinders (e.g., having cylinder wall(s) 26 at least partially defining reciprocating element bore 24) in place so as to facilitate interaction of the reciprocating element 18 and other components associated with the pump 10.

Figure 5:
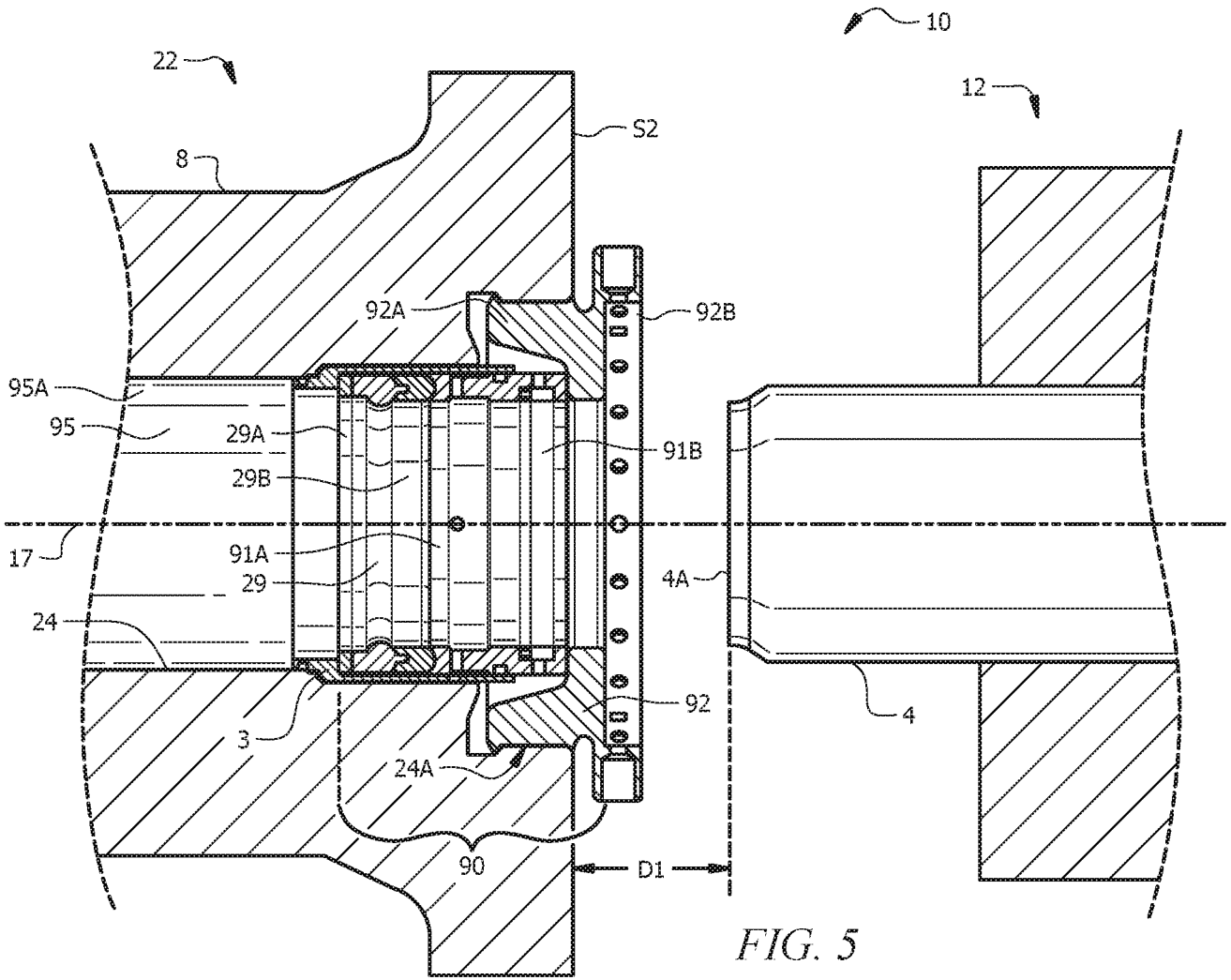
FIG. 5 is a cut-away illustration of a pump comprising a packing sleeve and a packing assembly, according to embodiments of the present disclosure.

With reference to FIG. 5, which is a cut-away illustration of a pump 10, cylinder wall 26 can be provided by a cylindrical packing sleeve 95, in embodiments. Sleeve 95 can be press fit (e.g., interference fit) into reciprocating element bore 24, in embodiments. Sleeve 95 can have an inner surface 95A about an inside diameter thereof and proximate reciprocating element 18.

With reference to FIG. 5, in embodiments, a packing assembly 90 comprising packing 29 is positioned within sleeve 95. In embodiments, pump fluid end 22 comprises a packing assembly 90, such that packing 29, a packing carrier 91, and a packing screw 92 can be removed from back S2 of pump fluid end 22 when crankshaft 16 is at TDC, as described, for example, in U.S. patent application Ser. No. 16/411,911 filed May 14, 2019, which is entitled "Pump Fluid End with Positional Indifference for Maintenance", the disclosure of which is hereby incorporated herein in its entirety for purposes not contrary to this disclosure.

FIG. 6 is a cut-away illustration of a pump 10 comprising a packing assembly 90 in pump fluid end 22, with a crankshaft 16 (FIG. 4) at top dead center (TDC), according to embodiments of the present disclosure. Packing assembly 90 comprises a packing screw 92, a packing carrier 91, and a packing 29. Packing screw 92, packing carrier 91, and packing 29 are cylindrical and have a width measured an axial distance along a central axis thereof (i.e., central axis 17, when assembled in pump fluid end 22) that is less than the minimum spacing distance D1 of pump 10 comprising the pump fluid end 22 and a pump power end 12. When packing assembly 90 is assembled in pump fluid end 22, the central axis of packing screw 92, the central axis of packing carrier 91, and the central axis of packing 29 are coincident (also referred to as coaxial) with central axis 17 of reciprocating element bore 24.

As described hereinabove with reference to FIGS. 1-4, pump fluid end 22 comprises a reciprocating element bore 24 in which a reciprocating element 18 can be reciprocated via the pump power end 12 via connection of a tail end 62 of the reciprocating element 18 to a pushrod 30 and crankshaft 16 of the pump power end 12, via one or more mechanical linkages 4. In the embodiment of FIG. 6, the front 4A of the one or more mechanical linkages 4 (FIG. 4) is positioned a minimum spacing distance D1 that is an axial distance measured along the central axis 17 between back S2 of the pump fluid end 22 and a front end 4A of the mechanical linkages 4 component closest to pump fluid end 22 when the crankshaft 16 of the pump power end 22 is at top dead center (TDC). The component of mechanical linkages 4 closest to pump fluid end 22 when crankshaft 16 of pump power end 12 is at TDC can comprise, for example, an adapter configured to couple reciprocating element 18 with a pushrod 30 of pump power end 12. When assembled, packing assembly 90 can be positioned generally where packing 29 is depicted in FIG. 2A, FIG. 2B, and FIG. 3.

Packing screw 92 can be designed such that, once packing 29 and packing carrier 91 are inserted into reciprocating element bore 24 of pump fluid end 22, packing screw 92 can be inserted into reciprocating element bore 24 and coupled (e.g., threaded together) with pump fluid body 8 of pump fluid end 22, such that packing screw 92 retains packing carrier 91 and packing screw 29 in pump fluid end 22 during pump operation.

In the embodiment of FIG. 6, pump 10 comprises cylindrical sleeve 95 (as described hereinabove) within reciprocating element bore 24. Packing 29, packing carrier 91, packing screw 92, or a combination thereof can be located within such a sleeve 95 toward the back S2 of the pump fluid end 22. In some such embodiments, pump fluid end 22 is a concentric bore pump fluid end 22, such as described hereinabove with reference to the embodiment of FIG. 3. Alternatively, packing 29, packing carrier 91, packing screw 92, or a combination thereof can be located within reciprocating element bore 24 toward the back S2 of the pump fluid end 22, the reciprocating element bore 24 containing no sleeve 95. In some such embodiments, pump fluid end 22 is a cross-bore pump fluid end 22, such as described hereinabove with reference to the embodiment of FIG. 2A-2B.

With respect to a front side and a back side of packing 29, packing carrier 91, and packing screw 92, the front side is axially distal the pump power end 12 (i.e., is farther along central axis 17 from pump power end 12) relative to the back side thereof, which is axially proximate pump power end 12 (i.e., is closer along central axis 17 to pump power end 12 than the front side). Upon assembly within pump fluid end 22, a front side 29A of packing 29 is distal pump power end 12, a back side 29B of the packing 29 axially proximate the pump power end 12 contacts a front side 91A of the packing carrier 91 axially distal the pump power end 21, and at least a portion of a front side 92A of the packing screw axially distal the pump power end 12 contacts a back side 91B of the packing carrier 91 axially proximate the pump power end 12.

In embodiments, packing screw 92 comprises threads on at least a portion of an outside diameter thereof, or other features, whereby the packing screw 92 can be threadably, or otherwise, connected with a mating thread on a portion 24A of an inside diameter of the reciprocating element bore 24 (and/or sleeve 95 therein), such that, upon assembly within pump fluid end 22, the packing screw 92 retains the packing 29 and the packing carrier 91 in the pump fluid end 22.

In embodiments, when assembled into packing assembly 90, packing 29 is positioned within the reciprocating element bore 24 and/or sleeve 95 therein toward the back S2 of the pump fluid end 22 such that front side 29A of packing 29 is in contact with a shoulder or stop feature 3 associated with reciprocating element bore 24 and/or sleeve 95. When assembled into packing assembly 90, packing carrier 91 is positioned such that front side 91A of the packing carrier 91 distal pump power end 12 is in contact with back side 29B of the packing 29 proximate the pump power end. When assembled into packing assembly 90, the packing screw 92 is positioned such that at least a portion of front side 92A of the packing screw 92 is in contact with back side 91B of the packing carrier 91 proximate the pump power end 12 and the packing screw 92 is coupled (e.g., threaded) with an inside surface of the reciprocating element bore 24 and/or packing sleeve 95. Once assembled, the packing screw 92 thus retains the packing carrier 91 and the packing 29 within the pump fluid end 22.

In embodiments, the reciprocating element 18 comprises a plunger or a piston. While the reciprocating element 18 may be described herein with respect to embodiments comprising a plunger, it is to be understood that the reciprocating element 18 may comprise any suitable component for displacing fluid. In a non-limiting example, the reciprocating element 18 may be a piston. As those versed in the art will readily appreciate, a piston-type pump generally employs sealing elements (e.g., rings, packing, etc.) attached to the piston and movable therewith. In contrast, a plunger-type pump generally employs fixed or static seals (e.g., primary seal or packing 29) through which the plunger moves during each stroke (e.g., suction stroke or discharge stroke).

As skilled artisans will understand, the reciprocating element 18 may include any suitable size and/or shape for extending and retracting along a flow path within the pump fluid end 22. For instance, reciprocating element 18 may comprise a generally cylindrical shape, and may be sized such that the reciprocating element 18 can sufficiently slide against or otherwise interact with the inner cylinder wall 26 (e.g., provided by pump fluid end body 8 and/or sleeve 95). Reciprocating element 18 has an outer surface 18A about an outside diameter thereof. In embodiments, one or more additional components or mechanical linkages 4 (FIG. 4; e.g., clamps, adapters, extensions, etc.) may be used to couple the reciprocating element 18 to the pump power end 12 (e.g., to a pushrod 30).

In some embodiments (e.g., cross-bore pump fluid end 22 embodiments such as FIG. 2A), the reciprocating element may be substantially solid and/or impermeable (e.g., not hollow). In alternative embodiments (e.g., tee-bore pump fluid end 22 embodiment such as FIG. 2B and concentric bore pump fluid end 22 embodiment such as FIG. 3), the reciprocating element 18 comprises a peripheral wall defining a hollow body. Additionally (e.g., tee-bore pump fluid end 22 embodiments such as FIG. 2B and concentric bore pump fluid end 22 embodiments such as FIG. 3), a portion of the peripheral wall of reciprocating element 18 may be generally permeable or may include an input through which fluid may enter the hollow body and an output through which fluid may exit the hollow body. Furthermore, while the reciprocating element 18 may, in embodiments, define a substantially hollow interior and include a ported body, a base of the reciprocating element 18 proximal the pump power end 12, when assembled, may be substantially solid and/or impermeable (e.g., a plunger having both a hollow portion and a solid portion).

The reciprocating element 18 comprises a front or free end 60. In embodiments comprising concentric bore pump fluid end designs 22 such as shown in FIG. 3, the reciprocating element 18 can contain or at least partially contain the suction valve assembly 56. In one aspect, the suction valve assembly 56 is at least partially disposed within the reciprocating element 18 at or proximate to the front end 60 thereof. At an opposite or tail end 62 (also referred to as back end 62) of the reciprocating element 18, the reciprocating element 18 may include a base coupled to the pump power end 12 of the pump 10 (e.g., via crank arm 20). In embodiments, the tail end 62 of the reciprocating element 18 is coupled to the pump power end 12 outside of pump fluid end 22, e.g., within integration section 11.

As noted above, pump fluid end 22 contains a suction valve assembly 56. Suction valve assembly 56 may alternately open or close to permit or prevent fluid flow. Skilled artisans will understand that the suction valve assembly 56 may be of any suitable type or configuration (e.g., gravity- or spring-biased, flow activated, etc.). Those versed in the art will understand that the suction valve assembly 56 may be disposed within the pump fluid end 22 at any suitable location therein. For instance, the suction valve assembly 56 may be disposed within the bore 25 below central axis 17 of the pump fluid end 22, in cross-bore pump fluid end 22 designs such as FIG. 2A, such that a suction valve body (e.g., a poppet) of the suction valve assembly 56 moves away from a suction valve seat within the a suction valve seat housing of reciprocating element 18 when the suction valve assembly 56 is in an open configuration and toward the suction valve seat when the suction valve assembly 56 is in a closed configuration. The suction valve assembly 56 may be disposed within reciprocating element bore 24 and at least partially within reciprocating element 18 in tee-bore pump fluid end 22 designs such as FIG. 2B and concentric bore pump fluid end 22 designs such as FIG. 3, such that a suction valve body (e.g., a poppet) of the suction valve assembly 56 moves away from a suction valve seat within and/or coupled with a suction valve seat housing of reciprocating element 18 when the suction valve assembly 56 approaches an open configuration (i.e., is opening) and toward the suction valve seat when the suction valve assembly 56 approaches a closed configuration (e.g., is closing).

Pump 10 comprises a discharge valve assembly 72 for controlling the output of fluid through discharge chamber 53 and discharge outlet 54. Analogous to the suction valve assembly 56, the discharge valve assembly 72 may alternately open or close to permit or prevent fluid flow. Those versed in the art will understand that the discharge valve assembly 72 may be disposed within the pump chamber at any suitable location therein. For instance, the discharge valve assembly 72 may be disposed within the bore 25 proximal the top S3 of the pump fluid end 22, in cross-bore pump fluid end 22 designs such as FIG. 2A and tee-bore pump fluid end 22 designs such as FIG. 2B, such that a discharge valve body (e.g., a poppet) of the discharge valve assembly 72 moves toward the discharge chamber 53 when the discharge valve assembly 72 approaches an open configuration and away from the discharge chamber 53 when the discharge valve assembly 72 approaches a closed configuration. The discharge valve assembly 72 may be disposed proximal the front S1 of bore 24 of the pump fluid end 22 (e.g., at least partially within discharge chamber 53 and/or pump chamber 28) in concentric bore pump fluid end 22 designs such as FIG. 3, such that a discharge valve body (e.g., a poppet) of the discharge valve assembly 72 moves toward the discharge chamber 53 when the discharge valve assembly 72 approaches an open configuration and away from the discharge chamber 53 when the discharge valve assembly 72 approaches a closed configuration. In addition, the discharge valve assembly 72 may be co-axially aligned with the suction valve assembly 56 (e.g., along central axis 17 in concentric bore pump fluid end 22 configurations such as FIG. 3 or along central axis 27 of bore 25 perpendicular to central axis 17 in cross-bore pump fluid end 22 configurations such as FIG. 2A and FIG. 2B). In concentric bore pump fluid end 22 configurations such as FIG. 3, the suction valve assembly 56 and the discharge valve assembly 72 may be coaxially aligned with the reciprocating element 18 (e.g., along central axis 17).

Further, the suction valve assembly 56 and the discharge valve assembly 72 can comprise any suitable mechanism for opening and closing valves. For example, the suction valve assembly 56 and the discharge valve assembly 72 can comprise a suction valve spring and a discharge valve spring, respectively. Additionally, any suitable structure (e.g., valve assembly comprising sealing rings, stems, poppets, valve guides, etc.) and/or components may be employed for retaining the components of the suction valve assembly 56 and the components of the discharge valve assembly 72 within the pump fluid end 22.

The fluid inlet 38 may be arranged within any suitable portion of the pump fluid end 22 and configured to supply fluid to the pump in any direction and/or angle. Moreover, the pump fluid end 22 may comprise and/or be coupled to any suitable conduit (e.g., pipe, tubing, or the like) through which a fluid source may supply fluid to the fluid inlet 38. The pump 10 may comprise and/or be coupled to any suitable fluid source for supplying fluid to the pump via the fluid inlet 38. In embodiments, the pump 10 may also comprise and/or be coupled to a pressure source such as a boost pump (e.g., a suction boost pump) fluidly connected to the pump 10 (e.g., via inlet 38) and operable to increase or "boost" the pressure of fluid introduced to pump 10 via fluid inlet 38. A boost pump may comprise any suitable type including, but not limited to, a centrifugal pump, a gear pump, a screw pump, a roller pump, a scroll pump, a piston/plunger pump, or any combination thereof. For instance, the pump 10 may comprise and/or be coupled to a boost pump known to operate efficiently in high-volume operations and/or may allow the pumping rate therefrom to be adjusted. Skilled artisans will readily appreciate that the amount of added pressure may depend and/or vary based on factors such as operating conditions, application requirements, etc. In one aspect, the boost pump may have an outlet pressure greater than or equal to about 70 psi, about 80 psi, or about 110 psi, providing fluid to the suction side of pump 10 at about said pressures. Additionally or alternatively, the boost pump may have a flow rate of greater than or equal to about 80 BPM, about 70 BPM, and/or about 50 BPM.

As noted hereinabove, the pump 10 may be implemented as a multi-cylinder pump comprising multiple cylindrical reciprocating element bores 24 and corresponding components. In embodiments, the pump 10 is a Triplex pump in which the pump fluid end 22 comprises three reciprocating assemblies, each reciprocating assembly comprising a suction valve assembly 56, a discharge valve assembly 72, a pump chamber 28, a fluid inlet 38, a discharge outlet 54, and a reciprocating element bore 24 within which a corresponding reciprocating element 18 reciprocates during operation of the pump 10 via connection therewith to a (e.g., common) pump power end 12. In embodiments, the pump 10 is a Quintuplex pump in which the pump fluid end 22 comprises five reciprocating assemblies. In a non-limiting example, the pump 10 may be a Q10™ Quintuplex Pump or an HT-400™ Triplex Pump, produced by Halliburton Energy Services, Inc.

In embodiments, the pump fluid end 22 may comprise an external manifold (e.g., a suction header) for feeding fluid to the multiple reciprocating assemblies via any suitable inlet(s). Additionally or alternatively, the pump fluid end 22 may comprise separate conduits such as hoses fluidly connected to separate inlets for inputting fluid to each reciprocating assembly. Of course, numerous other variations may be similarly employed, and therefore, fall within the scope of the present disclosure.

Those skilled in the art will understand that the reciprocating elements of each of the reciprocating assemblies may be operatively connected to the pump power end 12 of the pump 10 according to any suitable manner. For instance, separate connectors (e.g., cranks arms/connecting rods 20, one or more additional components or mechanical linkages 4, pushrods 30, etc.) associated with the pump power end 12 may be coupled to each reciprocating element body or tail end 62. The pump 10 may employ a common crankshaft (e.g., crankshaft 16) or separate crankshafts to drive the multiple reciprocating elements.

As previously discussed, the multiple reciprocating elements may receive a supply of fluid from any suitable fluid source, which may be configured to provide a constant fluid supply. Additionally or alternatively, the pressure of supplied fluid may be increased by adding pressure (e.g., boost pressure) as described previously. In embodiments, the fluid inlet(s) 38 receive a supply of pressurized fluid comprising a pressure ranging from about 30 psi to about 300 psi.

Additionally or alternatively, the one or more discharge outlet(s) 54 may be fluidly connected to a common collection point such as a sump or distribution manifold, which may be configured to collect fluids flowing out of the fluid outlet(s) 54, or another cylinder bank and/or one or more additional pumps.

During pumping, the multiple reciprocating elements 18 will perform forward and returns strokes similarly, as described hereinabove. In embodiments, the multiple reciprocating elements 18 can be angularly offset to ensure that no two reciprocating elements are located at the same position along their respective stroke paths (i.e., the plungers are "out of phase"). For example, the reciprocating elements may be angularly distributed to have a certain offset (e.g., 120 degrees of separation in a Triplex pump) to minimize undesirable effects that may result from multiple reciprocating elements of a single pump simultaneously producing pressure pulses. The position of a reciprocating element is generally based on the number of degrees a pump crankshaft (e.g., crankshaft 16) has rotated from a bottom dead center (BDC) position. The BDC position corresponds to the position of a fully retracted reciprocating element at zero velocity, e.g., just prior to a reciprocating element moving (i.e., in a direction indicated by arrow 117 in FIGS. 2A-2B and FIG. 3) forward in its cylinder. A top dead center position corresponds to the position of a fully extended reciprocating element at zero velocity, e.g., just prior to a reciprocating element moving backward (i.e., in a direction indicated by arrow 116 in FIGS. 2A-2B and FIG. 3) in its cylinder.

As described above, each reciprocating element 18 is operable to draw in fluid during a suction (backward or return) stroke and discharge fluid during a discharge (forward) stroke. Skilled artisans will understand that the multiple reciprocating elements 18 may be angularly offset or phase-shifted to improve fluid intake for each reciprocating element 18. For instance, a phase degree offset (at 360 degrees divided by the number of reciprocating elements) may be employed to ensure the multiple reciprocating elements 18 receive fluid and/or a certain quantity of fluid at all times of operation. In one implementation, the three reciprocating elements 18 of a Triplex pump may be phase-shifted by a 120-degree offset. Accordingly, when one reciprocating element 18 is at its maximum forward stroke position, a second reciprocating element 18 will be 60 degrees through its discharge stroke from BDC, and a third reciprocating element will be 120 degrees through its suction stroke from top dead center (TDC).

Figure 6A:
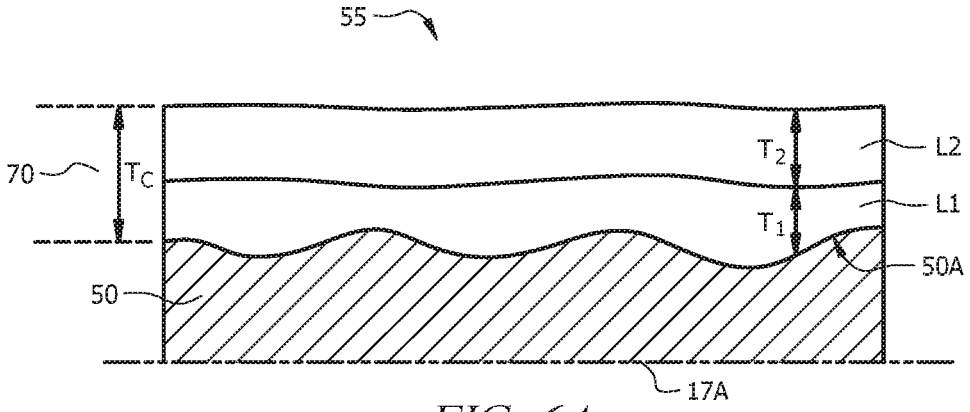
FIG. 6A is a schematic of a substrate having a coating disposed thereon, according to embodiments of this disclosure.
Figure 6B:
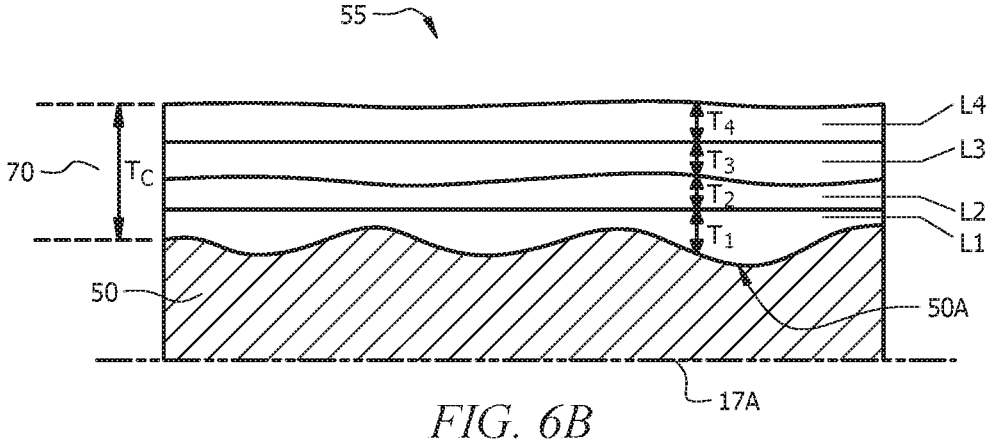
FIG. 6B is a schematic of a substrate having a coating disposed thereon, according to embodiments of this disclosure.

Herein disclosed are a multi-layer coating for a substrate, a substrate having disposed thereon the multi-layer coating, a pump fluid end 22 comprising such a coated substrate, and a pump comprising such a pump fluid end 22. FIG. 6A is a schematic of a substrate 50 having a coating 70 disposed thereon to provide a coated substrate 55, according to embodiments of this disclosure. FIG. 6B is a schematic of a substrate 50 having a coating 70 disposed thereon to provide a coated substrate 55, according to other embodiments of this disclosure. Substrate 50 has coating contact surface 50A to which a first layer L1 of multi-layer coating 70 is directly applied. At least a second layer L2 is disposed over at least a portion of first layer L1. At least one of the plurality of layers L has a different visual appearance and/or material composition than at least one other of the plurality of layers L.

In embodiments, as depicted in the embodiment of FIG. 6A, the multilayer surface coating 70 consists of the first layer L1 and the second layer L2, and the first layer L1 has a different visual appearance and/or material composition than the second layer L2. In embodiments, a color of the second layer L2 is different from a color of the first layer L1. For example, and without limitation, in embodiments, the color of the first layer L1 can be yellow. In embodiments, the color or the second layer L2 is black, grey, brown, blue, or white.

In embodiments, the multilayer surface coating 70 further comprises at least one additional layer disposed on the second layer. For example, as depicted in the embodiment of FIG. 6B, in embodiments, the multi-layer coating 70 comprises a third layer L3 disposed over at least a portion of the second layer L2 and/or a fourth layer L4 disposed over at least a portion of the third layer L3.

In embodiments, each layer of the plurality of layers L has an average thickness $T_L$ in a range of from about 0.01 to about 0.04 inch (from about 254 to about 1016 μm), from about 0.01 to about 0.03 inch (from about 254 to about 762 μm), from about 0.01 to about 0.02 inch (from about 254 to about 508 μm), or less than or equal to about 0.04 inch (1016 μm), 0.03 inch (762 μm), 0.02 inch (508 μm), or 0.01 inch (254 μm). In embodiments, an average thickness T1 of the first layer L1, an average thickness T2 of the second layer L2, an average thickness T3 of the third layer L3, and/or an average thickness T4 of the fourth layer L4 is in a range of from about 0.01 to about 0.04 inch (from about 254 to about 1016 μm), from about 0.01 to about 0.03 inch (from about 254 to about 762 μm), from about 0.01 to about 0.02 inch (from about 254 to about 508 μm), or less than or equal to about 0.04 inch (1016 μm), 0.03 inch (762 μm), 0.02 inch (508 μm), or 0.01 inch (254 μm). In embodiments, a thickness of the first layer L1 is less uniform along a central axis of cylindrical substrate 50 than a thickness of the remaining layer(s).

In embodiments, a the multilayer surface coating 70 has an average thickness $T_C$ equal to the sum of the average thicknesses of each layer of the plurality of layers L of the coating 70 that is in a range of from about 0.01 to about 0.04 inch (from about 254 to about 1016 μm), from about 0.01 to about 0.03 inch (from about 254 to about 762 μm), from about 0.01 to about 0.02 inch (from about 254 to about 508 μm), or less than or equal to about 0.04 inch (1016 μm), 0.03 inch (762 μm), 0.02 inch (508 μm), or 0.01 inch (254 μm). For example, in embodiments such as depicted in FIG. 6A, an average thickness $T_C$ of multi-layer surface coating 70 of FIG. 6A is equivalent to the sum of the average thickness T1 of first layer L1 and the average thickness T2 of second coating L2. Such an average thickness $T_C$ of multi-layer surface coating 70 can be in a range of from about 0.01 to about 0.04 inch (from about 254 to about 1016 μm), from about 0.01 to about 0.03 inch (from about 254 to about 762 μm), from about 0.01 to about 0.02 inch (from about 254 to about 508 μm), or less than or equal to about 0.04 inch (1016 μm), 0.03 inch (762 μm), 0.02 inch (508 μm), or 0.01 inch (254 μm). In embodiments such as depicted in FIG. 6B, an average thickness $T_C$ of multi-layer surface coating 70 is equivalent to the sum of the average thickness T1 of first layer L1, the average thickness T2 of second coating L2, the average thickness T3 of third layer L3, and the average thickness T4 of fourth layer L4. Such an average thickness $T_C$ of multi-layer surface coating 70 of FIG. 6B can be in a range of from about 0.01 to about 0.04 inch (from about 254 to about 1016 μm), from about 0.01 to about 0.03 inch (from about 254 to about 762 μm), from about 0.01 to about 0.02 inch (from about 254 to about 508 μm), or less than or equal to about 0.04 inch (1016 μm), 0.03 inch (762 μm), 0.02 inch (508 μm), or 0.01 inch (254 μm).

In embodiments, at least one layer (e.g., first layer L1) of multi-layer coating 70 comprises a nickel-based spray layer, iron particles, an aluminum bronze layer, or a combination thereof. In embodiments, at least one other layer (e.g., second layer L2) of multi-layer coating 70 comprises titanium, ceramic alumina, a nickel-based spray, iron particles, or a combination thereof that is different from the at least one layer (e.g., the first layer L1).

In embodiments, at least one layer L of the plurality of layers (e.g., the first layer L1 and/or the second layer L2) of multi-layer coating 70 independently comprises a high velocity oxygen fuel (HVOF) layer, a combustion flame spray layer, a plasma spray layer, a vacuum plasma spray layer, a two wire electric arc spray layer, or a combination thereof. In embodiments, each layer of the plurality of layers L of multi-layer coating 70 independently comprises a nickel-based spray layer (e.g., COLMONOY®, available from WallColmonoy) that can have a grey color, a titanium nitride layer (e.g., a PVD coating) that can have a gold color, a ceramic alumina layer (e.g., a plasma spray layer) that can have a white color, an alumina bronze layer that can have a yellow color, or a combination thereof. In embodiments, an alumina bronze layer, having a yellow color which may be particularly suitable for use as a bond coat layer, is utilized as first layer L1 that directly contacts contact surface 50A of substrate 50.

By way of specific, non-limiting examples, an under bond layer (e.g., a first layer L1) of nickel based spray (e.g., COLMONOY), which has a grey color, can be utilized with an outer layer (e.g., a second layer L2) of titanium (e.g., physical vapor deposition (PVD) coating) having a gold color. Alternatively, an under bond layer (e.g., a first layer L1) of nickel based spray (e.g., COLMONOY), which has a grey color, can be utilized with an outer layer (e.g., a second layer L2) of ceramic alumina (e.g., a plasma spray) having a white color. Alternatively, an under bond layer (e.g., a first layer L1) of aluminum bronze, which has a yellow color can be utilized with an outer layer (e.g., a second layer L2) of nickel based spray (e.g., COLMONOY), having a grey color.

In embodiments, multi-layer coating 70 consists of a first layer L1 of alumina bronze that is yellow in color, and a second layer L2 of nickel based spray (e.g., COLMONOY), that is grey in color. In specific, non-limiting embodiments, the first layer L1 has a thickness T1 of about 0.020 inch (508 μm) and the second layer L2 has a thickness T2 of about 0.01 inch (254 μm).

In embodiments, the substrate 50 upon which multi-layer coating 70 is disposed includes reciprocating element 18, in which case the coating contact surface 50A comprises outer surface 18A of reciprocating element 18 (FIGS. 2A-2B and FIG. 3) prior to coating thereof with multi-layer coating 70. In embodiments, a coated reciprocating element 18 (e.g., a reciprocating element 18 coated with a multi-layer surface coating 70 of this disclosure) can be utilized to provide a wear level determination of the reciprocating element packing 29 and/or of the coated reciprocating element 18. As noted hereinabove, the reciprocating element 18 can be a plunger, wherein packing 29 does not reciprocate along with reciprocation of the plunger. In embodiments, reciprocating element 18 comprises a piston comprising one or seals (e.g., sealing rings) disposed about an outer circumference thereof, wherein the one or more seals reciprocate with the piston. In embodiments in which reciprocating element 18 is a piston, optional sleeve 95 can comprise a piston liner.

In embodiments, the substrate 50 upon which multi-layer surface coating 70 is disposed includes sleeve 95, in which case the coating contact surface 50A comprises inner surface 95A (FIG. 5) prior to coating thereof with multi-layer surface coating 70. In embodiments, a coated sleeve 95 (e.g., a sleeve 95 coated with a multi-layer surface coating 70 of this disclosure) can be utilized to provide a wear level determination of the packing 29 and/or of the coated sleeve 95. In embodiments, at least a portion of the outer surface 18A of the reciprocating element comprises a multilayer surface coating 70 of this disclosure and at least a portion of the inner surface 95A of the sleeve 95 comprises a multilayer surface coating 70 of this disclosure, which can be the same as or different from the coating of the at least a portion of the outer surface 18A of the reciprocating element 18. Coating both the reciprocating element and the sleeve can be utilized to provide a redundancy in the wear level determination of the packing 29, while also providing a wear level indication of the coated reciprocating element 18 and the coated sleeve 95, respectively.

Sleeve 95 can be a replaceable sleeve 95, an insert sleeve 95, and/or a stuffing box 95 that houses reciprocating element packing 29. The life of reciprocating element packing 29 can be affected by the condition of sleeve 95 and/or reciprocating element 18. Dimensional wear, scratches, and/or pitting of sleeve 95 and/or reciprocating element 18 can detrimentally affect the life of reciprocating element packing 29. Accordingly, the use of a multi-layer surface coating 70 on sleeve 95 and/or reciprocating element 18, such that wear of sleeve 95 and/or reciprocating element 18 can be determined by examination of the inner surface 95A or the outer surface, 18A respectively, thereof as described hereinbelow, can result in repair and/or replacement of sleeve 95 and/or reciprocating element 18 prior to unacceptable wear on reciprocating element packing 29, in embodiments. The wear on a coated sleeve 95 and/or a coated reciprocating element 18 can also be utilized to determine the wear level of reciprocating element packing 29 and/or be utilized to determine when reciprocating element packing 29 will be (or is) in need of repair and/or replacement.

In embodiments, reciprocating element 18 comprises tool engagement features on front 60 thereof, whereby reciprocating element 18 can be removed from pump fluid end 22 by engaging a tool with the engagement features, as described, for example, in U.S. patent application Ser. No. 16/411,905 filed May 14, 2019, which is entitled "Pump Plunger with Wrench Features", the disclosure of which is hereby incorporated herein in its entirety for purposes not contrary to this disclosure.

In embodiments, reciprocating element 18 is coupled with a pushrod 30 (or another component of mechanical linkages 4 (FIG. 4)) of pump power end 12 via a reciprocating element adapter, as described, for example, in U.S. patent application Ser. No. 16/411,894 filed May 14, 2019, which is entitled "Easy Change Pump Plunger", the disclosure of which is hereby incorporated herein in its entirety for purposes not contrary to this disclosure.

Also disclosed herein is a pump fluid end comprising a coated substrate 55, as described hereinabove. Such a pump fluid end 22 comprising substrate 50 having disposed thereon multi-layer coating 70 to provide coated substrate 55 comprises: a cylindrical reciprocating element 18 disposed at least partially within a cylindrical reciprocating element bore 24 and having an outer surface 18A; a reciprocating element packing 29 positioned at a back S2 (FIG. 1, FIG. 2A-2B, FIG. 3, FIG. 5) of the pump fluid end 22 within the reciprocating element bore 24; and optionally a cylindrical sleeve 95 (FIG. 5) positioned within the reciprocating element bore 24 such that the reciprocating element 18 reciprocates within the sleeve 95 and having an inner surface 95A proximate the outer surface 18A of the reciprocating element 18. According to this disclosure, at least a portion of the outer surface 18A of the reciprocating element 18 and/or at least a portion of the inner surface 95A of the sleeve 95 comprises multi-layer surface coating 70 comprising a plurality of layers L. The plurality of layers L include: a first layer L1 in contact with the at least a portion of the outer surface 18A of the reciprocating element 18 and/or the at least a portion of the inner surface 95A of the sleeve 95; and a second layer L2 disposed over at least a portion of the first layer L1. According to this disclosure, at least one of the plurality of layers L has a different visual appearance and/or material composition than at least one other of the plurality of layers L. For example, when the multilayer surface coating 70 consists of the first layer L1 and the second layer L2, the first layer L1 has a different visual appearance (e.g., yellow color) and/or material composition than the second layer L2.

In embodiments, the different visual appearance comprises a different color (e.g., a L1 of the coating having a yellow color that becomes visible as all or a portion of L2 of the coating degrades or is otherwise removed). In embodiments, a different material composition comprises the presence of a magnetic material, such as iron particles. In embodiments, the difference in material composition can be determined by ultrasonic inspection, magnetic field detection, eddy current, liquid penetrant, visual inspection (e.g., color change(s)), or a combination thereof.

In embodiments, the multi-layer surface coating on the reciprocating element 18 is utilized to determine a wear level of the reciprocating element 18. In embodiments, the multi-layer surface coating on the sleeve 95 is utilized to determine a wear level of the sleeve 95. In embodiments, the multi-layer surface coating on the reciprocating element 18 and/or the sleeve 95 is utilized to determine a wear level of packing 29. In such embodiments, the visual appearance and/or material composition of each layer of the plurality of layers L can indicate a condition (e.g., a specific wear level) of the coated substrate 55 (e.g., of the coated reciprocating element 18 and/or of the coated sleeve 95) and/or of the packing 29. For example, in embodiments, the multi-layer surface coating 70 consists of first layer L1 and second layer L2, and an initial thickness $T2_i$ of the second layer L2 is equal to a maximum wear allowance of the coated substrate 55 and/or of the packing 29. Accordingly, if examination (e.g., visual examination, and/or other examination to determine a thickness and/or material composition of the exposed layer of multi-layer coating 70) of the coated substrate 55 (e.g., the coated reciprocating element 18 and/or the coated sleeve 95) reveals that first layer L1 is exposed (i.e., second layer L2 has been completely worn away at one or more positions along central axis 17A), the coated substrate and/or the packing 29 can be deemed to have worn a maximum level and can be determined to be in need of repair and/or replacement (i.e., repacking of reciprocating element packing 29 and/or replacement or recoating of the coated substrate (e.g., the coated reciprocating element 18 and/or the coated sleeve 95) is needed).

In embodiments, each layer of the plurality of layers L of multi-layer surface coating 70 indicates a specific wear level of the coated substrate 55 and/or of the packing 29. For example, with reference now to the embodiment of FIG. 6B, fourth layer L4 can indicate a first condition (or Condition A) of wear, third layer L3 can indicate a second condition (or Condition B) of wear, second layer L2 can indicate a third condition (or Condition C) of wear, and first layer L1 can indicate a fourth condition (or Condition D) of wear of reciprocating element 29 and/or of the coated substrate 55. For example, with reference to the embodiment of FIG. 6B, fourth layer L4 can indicate a "not worn" wear level of packing 29 and/or coated substrate 55, third layer L3 of multi-layer surface coating 70 can indicate a "slightly worn" wear level of packing 29 and/or coated substrate 55, second layer L2 of multi-layer surface coating 70 can indicate a "worn" wear level of packing 29 and/or coated substrate 55, and first layer L1 of multi-layer surface coating 70 can indicate an "unacceptably worn" wear level of packing 29 and/or coated substrate 55. This can be considered similar to a stoplight indicator, with an initially outermost layer (e.g., L4) of multi-layer surface coating 70 indicating "green" or "continue" status, a layer (e.g., L3) initially located just below the outermost layer (e.g., L4) of multi-layer surface coating 70 indicating "orange" or "continue but be prepared to replace packing 29 and/or coated substrate 55" status, and a layer (e.g., L2) initially located just below the second-outermost layer (e.g., L3) of multi-layer surface coating 70 indicating "red" or "replace packing 29 and/or coated substrate 55" status. A plethora of combinations of layers can be utilized to indicate specific wear levels of packing 29 and/or coated substrate 55. Inspection of the coated substrate, as described above (e.g., visual and/or other examination method(s)) can be utilized to determine which layer is now exposed (i.e., likewise which layer(s) have worn off), and thus determine the status of the wear level of the coated substrate 55 and/or the packing 29. Thus, an initial thickness $T_i$ of each of the plurality of wear layers L can be chosen based on a wear profile (e.g., wear depth allowances) of reciprocating element packing 29 and/or of the coated substrate 55.

Without limitation, each layer of the plurality of layers L can be disposed by a technique independently selected (i.e., the technique utilized to dispose each layer can be the same or different from a technique utilized to dispose one or more other layer(s) of the multi-layer surface coating 70) from high velocity oxygen fuel (HVOF), combustion flame spraying, plasma spraying, vacuum plasma spraying, two-wire electric arc spraying, or a combination thereof, in embodiments.

In embodiments, prior to disposing first layer L1 in contact with contact surface 50A of substrate 50 (e.g., outer surface 18A of reciprocating element 18 and/or inner surface 95A of sleeve 95 prior to any coating thereof) is ground, sanded, blasted, or otherwise roughened prior to disposing first layer L1 thereupon, which may aid in the adherence of a first layer L1 to a roughened outer surface of the substrate. Likewise, subsequent to disposing each layer of the plurality of layers L of multi-layer surface coating 70, the substrate coated with the prior layer(s) can be ground, sanded, or otherwise roughened prior to disposing the subsequent layer thereupon, which may aid in the adherence of a subsequent coating to a prior coating. The grinding and/or other roughening can be utilized to provide a desired average thickness to the layer and/or promote disposal of the subsequent layer thereupon. In embodiments, one or more layers L of the plurality of layers of multi-layer surface coating 70 are disposed or applied to the substrate robotically, and no grinding or other mechanical treatment is needed subsequent disposal of the layer to provide the desired layer thickness (i.e., the robotic disposal/application provides a layer having the desired average thickness along central axis 17A such that no further grinding or other mechanical treatment, except optionally a quick abrading to promote disposal and adherence of the subsequent layer, is utilized between disposal of each successive layer of the plurality of layers L. A final finish can be utilized subsequent disposal of the outermost layer (e.g., farthest from central axis 17A of substrate 50 in a direction perpendicular thereto such as L2 of FIG. 6A or L4 of FIG. 6B) of multi-layer surface coating 70.

The pump fluid end 22 can be a pump fluid end 22 as described hereinabove with reference to FIGS. 2A-2B and FIG. 3. Pump fluid end 22 comprises a suction valve assembly 56 and a discharge valve assembly 72.

In embodiments, a discharge valve seat of discharge valve assembly 72 and/or a suction valve seat of suction valve assembly 56 is a valve seat with supplemental retention, as described, for example, in U.S. patent application Ser. No. 16/411,898 filed May 14, 2019, which is entitled "Pump Valve Seat with Supplemental Retention", the disclosure of which is hereby incorporated herein in its entirety for purposes not contrary to this disclosure.

In embodiments, suction valve assembly 56 and/or discharge valve assembly 72 comprises a valve assembly having a valve guide, as described, for example, in U.S. patent application Ser. No. 16/411,910 filed May 14, 2019, which is entitled "Valve Assembly for a Fluid End with Limited Access", the disclosure of which is hereby incorporated herein in its entirety for purposes not contrary to this disclosure.

In embodiments, suction valve assembly 56 of pump fluid end 22 comprises an easy access suction valve, as described, for example, in U.S. patent application Ser. No. 16/411,891 filed May 14, 2019, which is entitled "Pump Fluid End with Easy Access Suction Valve", the disclosure of which is hereby incorporated herein in its entirety for purposes not contrary to this disclosure.

In embodiments, pump fluid end 22 comprises a suction valve stop for assisting closure of suction valve assembly 56, as described, for example, in U.S. patent application Ser. No. 16/436,312 filed Jun. 10, 2019, and published as U.S. patent application Publication No. 2020/0386214 A1, which is entitled "Pump Fluid End with Suction Valve Closure Assist", the disclosure of which is hereby incorporated herein in its entirety for purposes not contrary to this disclosure.

In embodiments, suction valve assembly 56 and/or discharge valve assembly 72 of pump fluid end 22 comprises a valve poppet assembly, as described, for example, in U.S. patent application Ser. No. 16/436,356 filed Jun. 10, 2019, now U.S. Pat. No. 10,808,851B1, which is entitled "Multi-Material Frac Valve Poppet", the disclosure of which is hereby incorporated herein in its entirety for purposes not contrary to this disclosure.

Also disclosed herein is a pump 10 comprising: a pump fluid end 22 as described hereinabove; and a pump power end 12 (FIG. 1 and FIG. 4). The pump power end 12 is operable to reciprocate the reciprocating element 18 within the reciprocating element bore 24 (and optionally within sleeve 95 in embodiments comprising optional sleeve 95) of the pump fluid end 22. As described hereinabove, the reciprocating element 18 and/or the optional sleeve 95 comprise a coated substrate 55 (i.e., a coated reciprocating element 18 and/or a coated sleeve 95, respectively) having a multi-layer surface coating 70 of this disclosure disposed thereon.

In embodiments, pump 10 of this disclosure is a concentric bore pump fluid end 22 such as depicted in FIG. 3 and described hereinabove or a cross-bore pump fluid end such as depicted in FIG. 2A and FIG. 2B and described hereinabove. In embodiments, pump fluid end 22 comprises a reciprocating element 18 coupled with a suction valve assembly 56, such as the cross-bore (e.g., T-bore) pump fluid end 22 of FIG. 2B and the concentric bore pump fluid end 22 of FIG. 3. In some such embodiments, pump 10 further comprises a flexible manifold, as described, for example, in U.S. patent application Ser. No. 16/411,901 filed May 14, 2019, which is entitled "Flexible Manifold for Reciprocating Pump", the disclosure of which is hereby incorporated herein in its entirety for purposes not contrary to this disclosure.

Also disclosed herein is a method of indicating and/or determining the wear level of a reciprocating element packing 29 and/or the coated substrate 55 of a pump 10. The method comprises: coating at least a portion of an outer surface 18A of a cylindrical reciprocating element 18 and/or at least a portion of an inner surface 95A of a cylindrical sleeve 95 with a multi-layer surface coating 70 comprising a plurality of layers L. The coating includes disposing a first layer L1 in contact with the at least a portion of the outer surface 18A (e.g., the reciprocating element 19 comprising the contact surface 50A of the substrate 50) of the reciprocating element 18 and/or the at least a portion of the inner surface 95A (e.g., the sleeve 95 comprising the contact surface 50A of the substrate 50) of the sleeve 95, and disposing one or more additional layers (e.g., a second layer L2) over at least a portion of the first layer L1. The multi-layer surface coating 70 can comprise a desired total number of layers and can otherwise be as described in detail hereinabove. At least one of the plurality of layers L has a different visual appearance and/or material composition than at least one other of the plurality of layers L, and a thickness $T_L$ of each layer of the plurality of layers L correlates with a level of wear of the reciprocating element packing 29 and/or coated substrate 55. The wear level of the pump 10 can be determined by examining the coated substrate 55 (e.g., the coated reciprocating element 18 and/or the coated sleeve 95), determining which layer (e.g., an innermost exposed layer) of the multi-layer surface coating 70 is exposed, and correlating the exposed layer (e.g., an innermost exposed layer) with a wear level of the packing 29 and/or the coated substrate 55.

As described herein, disposing each layer of the plurality of layers L of multi-layer coating 70 (e.g., disposing/applying the first layer L1, disposing/applying the second layer L2, disposing/applying the third layer L3, disposing/applying the fourth layer L4, and so on) can comprise disposing/applying via a technique independently selected from: high velocity oxygen fuel (HVOF), combustion flame spraying, plasma spraying, vacuum plasma spraying, two-wire electric arc spraying, or a combination thereof.

In embodiments, a rate of wear of packing 29 and/or coated substrate 55 is determined based on examination of the coated substrate 55 (e.g., the coated reciprocating element 18 and/or the coated sleeve 95). For example, a rate of wear of packing 29 and/or coated substrate 55 can be determined by correlating a rate of wear of the thickness $T_C$ of coating 70 with a rate of wear of packing 29 and/or a rate of wear of coated substrate 55. In embodiments, the rate of wear of packing 29 and/or the rate of wear of coated substrate 55 can be utilized to predict when packing 29 and/or coated substrate 55 will be in need of repair and/or replacement.

As noted hereinabove, a pump 10 of this disclosure can be a multiplex pump comprising a plurality of reciprocating elements 18, and a corresponding plurality of reciprocating element bores 24, suction valve assemblies 56, discharge valve assemblies 72, and optional sleeves 95. The plurality can comprise any number such as, for example, 2, 3, 4, 5, 6, 7, or more. For example, in embodiments, pump 10 is a triplex pump, wherein the plurality comprises three. In alternative embodiments, pump 10 comprises a Quintuplex pump, wherein the plurality comprises five.

Also disclosed herein is a method of servicing a reciprocating pump 10 of this disclosure. The method comprises: inspecting a coated substrate located inside or proximate a reciprocating pump fluid end (e.g., an outer surface 18A of a reciprocating element 18 of the pump 10 and/or an inner surface 95A of a sleeve 95 positioned within a reciprocating element bore of the pump 10), wherein said inspecting provides an indication of a level of wear of a component of the fluid end (e.g., a reciprocating element packing 29, the sleeve 95, and/or the reciprocating element 18) of the pump 10. The method of servicing the pump 10 further comprises: responsive to the indication of the level or wear of the fluid end component (e.g., reciprocating element packing 29, the sleeve 95, and/or the reciprocating element 18), repairing or replacing the fluid end component (e.g., reciprocating element packing 29, the sleeve 95, and/or the reciprocating element 18). As noted hereinabove, in embodiments, the indication of the level of wear comprises a presence of a particular color (e.g., a yellow color of an innermost exposed/visible layer) indicating wear of a coating 70 (e.g., outer layer L2 of FIG. 6A) on the outer surface 18A of the reciprocating element 18 or wear of a coating 70 (e.g., outer layer L2 of FIG. 6A) on the inner surface 95A of the sleeve 95. For example, inspecting provides knowledge of what layer(s) (e.g., an innermost exposed layer that is detected/identified via inspection) of a multi-layer surface coating 70 are currently at least partially exposed (i.e., currently make up all or a portion of the outer surface 18A of reciprocating element 18 and/or the inner surface 95A of sleeve 95), and the layer(s) currently exposed can be correlated with a specific wear level of a component of the fluid end such as the packing 29, sleeve 95, and/or reciprocating element 18.

Figure 7:
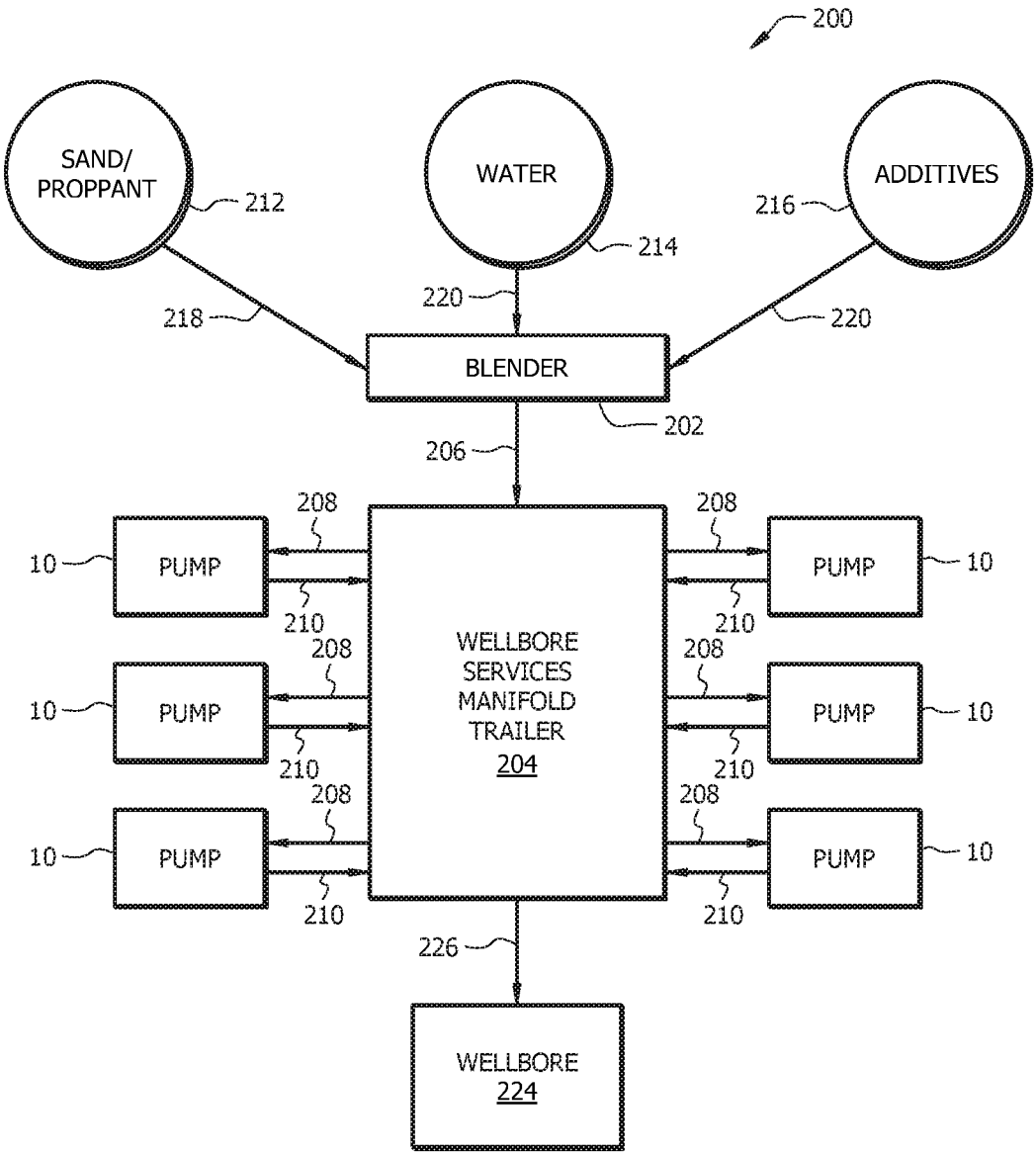
FIG. 7 is a schematic representation of an embodiment of a wellbore servicing system, according to embodiments of this disclosure.

Also disclosed herein are a method of servicing a wellbore and a wellbore servicing system 200 comprising a pump of this disclosure. An embodiment of a wellbore servicing system 200 and a method of servicing a wellbore via the wellbore servicing system 200 will now be described with reference to FIG. 7, which is a schematic representation of an embodiment of a wellbore servicing system 200, according to embodiments of this disclosure.

A method of servicing a wellbore 224 according to this disclosure comprises: fluidly coupling a pump 10 of this disclosure to a source of a wellbore servicing fluid and to the wellbore; and communicating a wellbore servicing fluid into the wellbore via the pump 10. As described hereinabove, the pump 10 comprises: a pump fluid end 22 and a pump power end 12. The pump power end 12 is operable to reciprocate cylindrical reciprocating element 18 (which may or may not be coated with a multi-layer surface coating 70 of this disclosure) within a cylindrical reciprocating element bore 24 (and optionally within an optional sleeve 95 within reciprocating element bore 24, which sleeve 95 may or may not be coated with a multi-layer surface coating 70 of this disclosure) of the pump fluid end 22. The pump fluid end 22 comprises the reciprocating element 18 disposed at least partially within the reciprocating element bore 24 (and optionally within the optional sleeve 95 disposed within reciprocating element bore 24), and the reciprocating element 18 has an outer surface 18A. The pump fluid end 22 of pump 22 comprises a reciprocating element packing 29 positioned at a back S2 (FIG. 1, FIG. 2A-2B, FIG. 3, and FIG. 5) of the pump fluid end 22 within the reciprocating element bore 24 (and optionally within optional sleeve 95 within reciprocating element bore 24). The pump fluid end 22 of pump 10 optionally comprises a sleeve 95 positioned within the reciprocating element bore 24 such that the reciprocating element 18 reciprocates within the sleeve 95. The optional sleeve has an inner surface 95A proximate the outer surface 18A of the reciprocating element 18. As noted above, according to this disclosure, at least a portion of the outer surface 18A of the reciprocating element 18 and/or at least a portion of the inner surface 95A of the sleeve 95 comprises a multi-layer surface coating 70 comprising a plurality of layers L. The plurality of layers L include a first layer L1 in contact with a contact surface 50A comprising at least a portion of the outer surface 18A of the reciprocating element 18 prior to coating thereof with multi-layer surface coating 70 and/or the at least a portion of the inner surface 95A of the sleeve 95 prior to coating thereof with multi-layer surface coating 70, and a second layer L2 disposed over at least a portion of the first layer L1. At least one of the plurality of layers L has a different visual appearance and/or material composition than at least one other of the plurality of layers L.

In embodiments, the method of servicing the wellbore further comprises discontinuing the communicating of the wellbore servicing fluid into the wellbore via the pump 10; examining the reciprocating element 18 and/or the sleeve 95 (which is/are coated with the multi-layer surface coating 70) to ascertain a wear level of the reciprocating element packing 29, the reciprocating element 18, and/or the sleeve 95 based on a visual appearance and/or material composition of the (coated) reciprocating element 18 and/or the (coated) sleeve 95. The method of servicing the wellbore can further comprise optionally subjecting the pump 10 to maintenance to provide a maintained pump 10, wherein the maintenance comprises repairing or replacing the reciprocating element packing 29, the sleeve 95, and/or the reciprocating element. The method of servicing the wellbore can further comprise communicating the or another wellbore servicing fluid into the wellbore via the pump 10 or the maintained pump 10.

It will be appreciated that the wellbore servicing system 200 disclosed herein can be used for any purpose. In embodiments, the wellbore servicing system 200 may be used to service a wellbore 224 that penetrates a subterranean formation by pumping a wellbore servicing fluid into the wellbore and/or subterranean formation. As used herein, a "wellbore servicing fluid" or "servicing fluid" refers to a fluid used to drill, complete, work over, fracture, repair, or in any way prepare a well bore for the recovery of materials residing in a subterranean formation penetrated by the well bore. It is to be understood that "subterranean formation" encompasses both areas below exposed earth and areas below earth covered by water such as ocean or fresh water. Examples of servicing fluids suitable for use as the wellbore servicing fluid, the another wellbore servicing fluid, or both include, but are not limited to, cementitious fluids (e.g., cement slurries), drilling fluids or muds, spacer fluids, fracturing fluids or completion fluids, and gravel pack fluids, remedial fluids, perforating fluids, diverter fluids, sealants, drilling fluids, completion fluids, gelation fluids, polymeric fluids, aqueous fluids, oleaginous fluids, etc.

In embodiments, the wellbore servicing system 200 comprises one or more pumps 10 operable to perform oilfield and/or well servicing operations. Such operations may include, but are not limited to, drilling operations, fracturing operations, perforating operations, fluid loss operations, primary cementing operations, secondary or remedial cementing operations, or any combination of operations thereof. Although a wellbore servicing system is illustrated, skilled artisans will readily appreciate that the pump 10 disclosed herein may be employed in any suitable operation.

In embodiments, the wellbore servicing system 200 may be a system such as a fracturing spread for fracturing wells in a hydrocarbon-containing reservoir. In fracturing operations, wellbore servicing fluids, such as particle laden fluids, are pumped at high-pressure into a wellbore. The particle laden fluids may then be introduced into a portion of a subterranean formation at a sufficient pressure and velocity to cut a casing and/or create perforation tunnels and fractures within the subterranean formation. Proppants, such as grains of sand, are mixed with the wellbore servicing fluid to keep the fractures open so that hydrocarbons may be produced from the subterranean formation and flow into the wellbore. Hydraulic fracturing may desirably create high-conductivity fluid communication between the wellbore and the subterranean formation.

The wellbore servicing system 200 comprises a blender 202 that is coupled to a wellbore services manifold trailer 204 via flowline 206. As used herein, the term "wellbore services manifold trailer" includes a truck and/or trailer comprising one or more manifolds for receiving, organizing, and/or distributing wellbore servicing fluids during wellbore servicing operations. In this embodiment, the wellbore services manifold trailer 204 is coupled to six positive displacement pumps (e.g., such as pump 10 that may be mounted to a trailer and transported to the wellsite via a semi-tractor) via outlet flowlines 208 and inlet flowlines 210. In alternative embodiments, however, there may be more or less pumps used in a wellbore servicing operation. Outlet flowlines 208 are outlet lines from the wellbore services manifold trailer 204 that supply fluid to the pumps 10. Inlet flowlines 210 are inlet lines from the pumps 10 that supply fluid to the wellbore services manifold trailer 204.

The blender 202 mixes solid and fluid components to achieve a well-blended wellbore servicing fluid. As depicted, sand or proppant 212, water 214, and additives 216 are fed into the blender 202 via feedlines 218, 220, and 212, respectively. The water 214 may be potable, non-potable, untreated, partially treated, or treated water. In embodiments, the water 214 may be produced water that has been extracted from the wellbore while producing hydrocarbons form the wellbore. The produced water may comprise dissolved and/or entrained organic materials, salts, minerals, paraffins, aromatics, resins, asphaltenes, and/or other natural or synthetic constituents that are displaced from a hydrocarbon formation during the production of the hydrocarbons. In embodiments, the water 214 may be flowback water that has previously been introduced into the wellbore during wellbore servicing operation. The flowback water may comprise some hydrocarbons, gelling agents, friction reducers, surfactants and/or remnants of wellbore servicing fluids previously introduced into the wellbore during wellbore servicing operations.

The water 214 may further comprise local surface water contained in natural and/or manmade water features (such as ditches, ponds, rivers, lakes, oceans, etc.). Still further, the water 214 may comprise water stored in local or remote containers. The water 214 may be water that originated from near the wellbore and/or may be water that has been transported to an area near the wellbore from any distance. In some embodiments, the water 214 may comprise any combination of produced water, flowback water, local surface water, and/or container stored water. In some implementations, water may be substituted by nitrogen or carbon dioxide; some in a foaming condition.

In embodiments, the blender 202 may be an Advanced Dry Polymer (ADP) blender and the additives 216 are dry blended and dry fed into the blender 202. In alternative embodiments, however, additives may be pre-blended with water using other suitable blenders, such as, but not limited to, a GEL PRO blender, which is a commercially available preblender trailer from Halliburton Energy Services, Inc., to form a liquid gel concentrate that may be fed into the blender 202. The mixing conditions of the blender 202, including time period, agitation method, pressure, and temperature of the blender 202, may be chosen by one of ordinary skill in the art with the aid of this disclosure to produce a homogeneous blend having a desirable composition, density, and viscosity. In alternative embodiments, however, sand or proppant, water, and additives may be premixed and/or stored in a storage tank before entering a wellbore services manifold trailer 204.

In embodiments, the pump(s) 10 (e.g., pump(s) 10 and/or maintained pump(s) 10) pressurize the wellbore servicing fluid to a pressure suitable for delivery into a wellbore 224 or wellhead. For example, the pumps 10 may increase the pressure of the wellbore servicing fluid (e.g., the wellbore servicing fluid and/or the another wellbore servicing fluid) to a pressure of greater than or equal to about 3,000 psi, 5,000 psi, 10,000 psi, 20,000 psi, 30,000 psi, 40,000 psi, or 50,000 psi, or higher.

From the pumps 10, the wellbore servicing fluid may reenter the wellbore services manifold trailer 204 via inlet flowlines 210 and be combined so that the wellbore servicing fluid may have a total fluid flow rate that exits from the wellbore services manifold trailer 204 through flowline 226 to the flow connector wellbore 1128 of between about 1 BPM to about 200 BPM, alternatively from between about 50 BPM to about 150 BPM, alternatively about 100 BPM. In embodiments, each of one or more pumps 10 discharge wellbore servicing fluid at a fluid flow rate of between about 1 BPM to about 200 BPM, alternatively from between about 50 BPM to about 150 BPM, alternatively about 100 BPM. In embodiments, each of one or more pumps 10 discharge wellbore servicing fluid at a volumetric flow rate of greater than or equal to about 3, 10, or 20 barrels per minute (BPM), or in a range of from about 3 to about 20, from about 10 to about 20, or from about 5 to about 20 BPM.

Persons of ordinary skill in the art with the aid of this disclosure will appreciate that the flowlines described herein are piping that are connected together for example via flanges, collars, welds, etc. These flowlines may include various configurations of pipe tees, elbows, and the like. These flowlines connect together the various wellbore servicing fluid process equipment described herein.

Also disclosed herein are methods for servicing a wellbore (e.g., wellbore 224). Without limitation, servicing the wellbore may include: positioning the wellbore servicing composition in the wellbore 224 (e.g., via one or more pumps 10 as described herein) to isolate the subterranean formation from a portion of the wellbore; to support a conduit in the wellbore; to plug a void or crack in the conduit; to plug a void or crack in a cement sheath disposed in an annulus of the wellbore; to plug a perforation; to plug an opening between the cement sheath and the conduit; to prevent the loss of aqueous or nonaqueous drilling fluids into loss circulation zones such as a void, vugular zone, or fracture; to plug a well for abandonment purposes; to divert treatment fluids; and/or to seal an annulus between the wellbore and an expandable pipe or pipe string. In other embodiments, the wellbore servicing systems and methods may be employed in well completion operations such as primary and secondary cementing operation to isolate the subterranean formation from a different portion of the wellbore.

In embodiments, a wellbore servicing method may comprise transporting a positive displacement pump (e.g., pump 10) to a site for performing a servicing operation. Additionally or alternatively, one or more pumps may be situated on a suitable structural support. Non-limiting examples of a suitable structural support or supports include a trailer, truck, skid, barge or combinations thereof. In embodiments, a motor or other power source for a pump may be situated on a common structural support.

In embodiments, a wellbore servicing method may comprise providing a source for a wellbore servicing fluid. As described above, the wellbore servicing fluid may comprise any suitable fluid or combinations of fluid as may be appropriate based upon the servicing operation being performed. Non-limiting examples of suitable wellbore servicing fluid include a fracturing fluid (e.g., a particle laden fluid, as described herein), a perforating fluid, a cementitious fluid, a sealant, a remedial fluid, a drilling fluid (e.g., mud), a spacer fluid, a gelation fluid, a polymeric fluid, an aqueous fluid, an oleaginous fluid, an emulsion, various other wellbore servicing fluid as will be appreciated by one of skill in the art with the aid of this disclosure, and combinations thereof. The wellbore servicing fluid may be prepared onsite (e.g., via the operation of one or more blenders) or, alternatively, transported to the site of the servicing operation.

In embodiments, a wellbore servicing method may comprise fluidly coupling a pump 10 to the wellbore servicing fluid source. As such, wellbore servicing fluid may be drawn into and emitted from the pump 10. Additionally or alternatively, a portion of a wellbore servicing fluid placed in a wellbore 224 may be recycled, i.e., mixed with the water stream obtained from a water source and treated in fluid treatment system. Furthermore, a wellbore servicing method may comprise conveying the wellbore servicing fluid from its source to the wellbore via the operation of the pump 10 disclosed herein.

In alternative embodiments, the reciprocating apparatus may comprise a compressor. In embodiments, a compressor similar to the pump 10 may comprise at least one each of a cylinder, plunger, connecting rod, crankshaft, and housing, and may be coupled to a motor. In embodiments, such a compressor may be similar in form to a pump and may be configured to compress a compressible fluid (e.g., a gas) and thereby increase the pressure of the compressible fluid. For example, a compressor may be configured to direct the discharge therefrom to a chamber or vessel that collects the compressible fluid from the discharge of the compressor until a predetermined pressure is built up in the chamber. Generally, a pressure sensing device may be arranged and configured to monitor the pressure as it builds up in the chamber and to interact with the compressor when a predetermined pressure is reached. At that point, the compressor may either be shut off, or alternatively the discharge may be directed to another chamber for continued operation.

In embodiments, a reciprocating apparatus comprises an internal combustion engine, hereinafter referred to as an engine. Such engines are also well known, and typically include at least one each of a plunger, cylinder, connecting rod, and crankshaft. The arrangement of these components is substantially the same in an engine and a pump (e.g. pump 10). A reciprocating element 18 such as a plunger may be similarly arranged to move in reciprocating fashion within the cylinder. Skilled artisans will appreciate that operation of an engine may somewhat differ from that of a pump. In a pump, rotational power is generally applied to a crankshaft acting on the plunger via the connecting rod, whereas in an engine, rotational power generally results from a force (e.g., an internal combustion) exerted on or against the plunger, which acts against the crankshaft via the connecting rod.

For example, in a typical 4-stroke engine, arbitrarily beginning with the exhaust stroke, the plunger is fully extended during the exhaust stroke, (e.g., minimizing the internal volume of the cylinder). The plunger may then be retracted by inertia or other forces of the engine componentry during the intake stroke. As the plunger retracts within the cylinder, the internal volume of cylinder increases, creating a low pressure within the cylinder into which an air/fuel mixture is drawn. When the plunger is fully retracted within the cylinder, the intake stroke is complete, and the cylinder is substantially filled with the air/fuel mixture. As the crankshaft continues to rotate, the plunger may then be extended, during the compression stroke, into the cylinder compressing the air-fuel mixture within the cylinder to a higher pressure.

A spark plug may be provided to ignite the fuel at a predetermined point in the compression stroke. This ignition increases the temperature and pressure within the cylinder substantially and rapidly. In a diesel engine, however, the spark plug may be omitted, as the heat of compression derived from the high compression ratios associated with diesel engines suffices to provide spontaneous combustion of the air-fuel mixture. In either case, the heat and pressure act forcibly against the plunger and cause it to retract back into the cylinder during the power cycle at a substantial force, which may then be exerted on the connecting rod, and thereby on to the crankshaft.

Those of ordinary skill in the art will readily appreciate various benefits that may be realized by the present disclosure. For instance, the herein disclosed fluid end design 22 comprising a multi-layer surface coating 70 indicative of a wear level of a component of the fluid end such as packing 29, a sleeve 95, and/or a reciprocating element 18 can facilitate determination of whether or not the fluid end component (e.g., a packing 29, a sleeve 95, and/or a reciprocating element 18) needs replacement and/or repair. The rate of wear of the fluid end component (e.g., packing 29, sleeve 95, and/or reciprocating element 18) can be calculated based on the rate at which the multi-layer coating 70 wears, and the rate of wear of the fluid end component (e.g., packing 29, sleeve 95, and/or reciprocating element 18) can be utilized to predict when the fluid end component (e.g., packing 29, sleeve 95, and/or reciprocating element 18) will need servicing (e.g., repair and/or replacement). Accordingly, a multi-layer surface coating 70 of this disclosure can be utilized to facilitate maintenance of a pump fluid end comprising a fluid end component substrate (e.g., an outer surface of reciprocating element 18 and/or an inner surface of packing sleeve 95) having the multi-layer surface coating disposed thereon. Use of the multi-layer surface coating 70 of this disclosure can reduce or minimize over-use or under-use replacement fluid end components such as of sleeves 95 and/or reciprocating elements 18, increase or maximize a life of packing 29, and/or reduce or minimize time lost due to out of service pumps 10.

Additional Disclosure

The following are non-limiting, specific embodiments in accordance with the present disclosure:

Embodiment A: A pump fluid end comprising: a cylindrical reciprocating element disposed at least partially within a cylindrical reciprocating element bore and having an outer surface; a reciprocating element packing positioned within the reciprocating element bore (e.g., at a back of the pump fluid end); and optionally a cylindrical sleeve positioned within the reciprocating element bore such that the reciprocating element reciprocates within the sleeve and having an inner surface proximate the outer surface of the reciprocating element, wherein at least a portion of the outer surface of the reciprocating element and/or at least a portion of the inner surface of the sleeve is coated with a multi-layer surface coating comprising a plurality of layers including: a first layer in contact with the at least a portion of the outer surface of the reciprocating element and/or the at least a portion of the inner surface of the sleeve; and a second layer disposed over at least a portion of the first layer; and wherein at least one of the plurality of layers has a different visual appearance and/or material composition than at least one other of the plurality of layers.

Embodiment B: The pump fluid end of Embodiment A, wherein the multilayer surface coating consists of the first layer and the second layer, and wherein the first layer has a different visual appearance and/or material composition than the second layer.

Embodiment C: The pump fluid end of Embodiment A or Embodiment B, wherein a color of the second layer is different from a color of the first layer.

Embodiment D: The pump fluid end of Embodiment C, wherein the color of the first layer is yellow.

Embodiment E: The pump fluid end of any of Embodiment A through Embodiment D, wherein the multilayer surface coating further comprises a third layer.

Embodiment F: The pump fluid end of any of Embodiment A through Embodiment E, wherein the first layer and/or the second layer has a thickness in a range of from about 0.01 to about 0.04 inch (from about 254 to about 1016 μm), from about 0.01 to about 0.03 inch (from about 254 to about 762 μm), from about 0.01 to about 0.02 inch (from about 254 to about 508 μm), or less than or equal to about 0.04 inch (1016 μm), 0.03 inch (762 μm), 0.02 inch (508 μm), or 0.01 inch (254 μm).

Embodiment G: The pump fluid end of any of Embodiment A through Embodiment F, wherein each layer of the plurality of layers has a thickness in a range of from about 0.01 to about 0.04 inch (from about 254 to about 1016 μm), from about 0.01 to about 0.03 inch (from about 254 to about 762 μm), from about 0.01 to about 0.02 inch (from about 254 to about 508 μm), or less than or equal to about 0.04 inch (1016 μm), 0.03 inch (762 μm), 0.02 inch (508 μm), or 0.01 inch (254 μm).

Embodiment H: The pump fluid end of any of Embodiment A through Embodiment G, wherein the multilayer surface coating has a thickness in a range of from about 0.01 to about 0.04 inch (from about 254 to about 1016 μm), from about 0.01 to about 0.03 inch (from about 254 to about 762 μm), from about 0.01 to about 0.02 inch (from about 254 to about 508 μm), or less than or equal to about 0.04 inch (1016 μm), 0.03 inch (762 μm), 0.02 inch (508 μm), or 0.01 inch (254 μm).

Embodiment I: The pump fluid end of any of Embodiment A through Embodiment H, wherein the at least a portion of the outer surface of the reciprocating element comprises the multilayer surface coating.

Embodiment J: The pump fluid end of any of Embodiment A through Embodiment I, wherein the at least a portion of the inner surface of the sleeve comprises the multilayer surface coating.

Embodiment K: The pump fluid end of any of Embodiment A through Embodiment J, wherein the first layer comprises a nickel-based spray layer, iron particles, an aluminum bronze layer, or a combination thereof.

Embodiment L: The pump fluid end of any of Embodiment A through Embodiment K, wherein the second layer comprises titanium, ceramic alumina, a nickel-based spray, iron particles, or a combination thereof that is different from the first layer.

Embodiment M: The pump fluid end of any of Embodiment A through Embodiment L, wherein the visual appearance and/or material composition of each layer of the plurality of layers indicates a condition (e.g., a specific wear level) of the packing, the coated reciprocating element, and/or the coated sleeve.

Embodiment N: The pump fluid end of any of Embodiment A through Embodiment M, wherein an initial thickness of the second layer is equal to a maximum wear allowance of the packing, the coated reciprocating element, and/or the coated sleeve.

Embodiment O: The pump fluid end of any of Embodiment A through Embodiment N, wherein the first layer and/or the second layer independently comprises a high velocity oxygen fuel (HVOF) layer, a combustion flame spray layer, a plasma spray layer, a vacuum plasma spray layer, a two wire electric arc spray layer, or a combination thereof.

Embodiment P: The pump fluid end of any of Embodiment A through Embodiment O, wherein each layer of the plurality of layers independently comprises a nickel-based spray layer, a titanium nitride layer, a ceramic alumina layer, an alumina bronze layer, or a combination thereof.

Embodiment Q: A pump comprising: the pump fluid end of any of Embodiment A through Embodiment P; and a pump power end, wherein the pump power end is operable to reciprocate the reciprocating element within the reciprocating element bore of the pump fluid end.

Embodiment R: A method of servicing a wellbore, the method comprising: fluidly coupling a pump to a source of a wellbore servicing fluid and to the wellbore; and communicating a wellbore servicing fluid into the wellbore via the pump, wherein the pump comprises: a pump fluid end and a pump power end, wherein the pump power end is operable to reciprocate a cylindrical reciprocating element within a cylindrical reciprocating element bore of the pump fluid end, and wherein the pump fluid end comprises: the reciprocating element disposed at least partially within the reciprocating element bore and having an outer surface; a reciprocating element packing positioned at a back of the pump fluid end within the reciprocating element bore; and optionally a sleeve positioned within the reciprocating element bore such that the reciprocating element reciprocates within the sleeve and having an inner surface proximate the outer surface of the reciprocating element, wherein at least a portion of the outer surface of the reciprocating element comprises a multi-layer surface coating and the reciprocating element is a coated reciprocating element and/or wherein at least a portion of the inner surface of the sleeve comprises a multi-layer surface coating and the sleeve is a coated sleeve, wherein the multi-layer surface coating comprises a plurality of layers including: a first layer in contact with the at least a portion of the outer surface of the reciprocating element and/or the at least a portion of the inner surface of the sleeve; and a second layer disposed over at least a portion of the first layer; and wherein at least one of the plurality of layers has a different visual appearance and/or material composition than at least one other of the plurality of layers.

Embodiment S: The method of Embodiment R further comprising: discontinuing the communicating of the wellbore servicing fluid into the wellbore via the pump; examining the coated reciprocating element and/or the coated sleeve to ascertain a wear level of the reciprocating element packing, the coated reciprocating element, and/or the coated sleeve based on a visual appearance and/or material composition of the coated reciprocating element and/or the coated sleeve; optionally subjecting the pump to maintenance to provide a maintained pump, wherein the maintenance comprises repairing or replacing the reciprocating element packing, the reciprocating element, and/or the sleeve; and communicating the or another wellbore servicing fluid into the wellbore via the pump or the maintained pump.

Embodiment T: The method of Embodiment R or Embodiment S, wherein the wellbore servicing fluid, the another wellbore servicing fluid, or both the wellbore servicing fluid and the another wellbore servicing fluid comprise a fracturing fluid, a cementitious fluid, a remedial fluid, a perforating fluid, a sealant, a drilling fluid, a spacer fluid, a completion fluid, a gravel pack fluid, a gelation fluid, a polymeric fluid, an aqueous fluid, an oleaginous fluid, or a combination thereof.

Embodiment U: The method of any of Embodiment R through Embodiment T, wherein the pump or the maintained pump operates during the pumping of the wellbore servicing fluid or the another wellbore servicing fluid at a pressure of greater than or equal to about 3,000 psi, 5,000 psi, 10,000 psi, 20,000 psi, 30,000 psi, 40,000 psi, or 50,000 psi.

Embodiment V: The method of any of Embodiment R through Embodiment U, wherein the pump or the maintained pump operates during the pumping of the wellbore servicing fluid or the another wellbore servicing fluid at a volumetric flow rate of greater than or equal to about 3, 10, or 20 barrels per minute (BPM), or in a range of from about 3 to about 20, from about 10 to about 20, or from about 5 to about 20 BPM.

Embodiment W: A method of indicating the wear level of a reciprocating element packing of a pump, the method comprising: coating at least a portion of an outer surface of a cylindrical reciprocating element or at least a portion of an inner surface of a cylindrical sleeve with a multi-layer surface coating comprising a plurality of layers by: disposing a first layer in contact with the at least a portion of the outer surface of the reciprocating element to provide a coated reciprocating element and/or the at least a portion of the inner surface of the sleeve to provide a coated sleeve; and disposing a second layer over at least a portion of the first layer, wherein at least one of the plurality of layers has a different visual appearance and/or material composition than at least one other of the plurality of layers, and wherein a thickness of each of the plurality of layers correlates with a level of wear of the reciprocating element packing, the coated reciprocating element, and/or the coated sleeve.

Embodiment X: The method of Embodiment W, wherein disposing the first layer and/or disposing the second layer comprises disposing via: high velocity oxygen fuel (HVOF), combustion flame spraying, plasma spraying, vacuum plasma spraying, two-wire electric arc spraying, or a combination thereof.

Embodiment Y: A method of servicing a reciprocating pump comprising: inspecting an outer surface of a reciprocating element of the pump and/or an inner surface of a sleeve positioned within a reciprocating element bore of the pump, wherein said inspecting provides an indication of a level of wear of a reciprocating element packing of the pump; and responsive to the indication of a level or wear of the reciprocating element packing, repairing or replacing the reciprocating element packing.

Embodiment Z: The method of Embodiment Y, wherein the indication of a level of wear comprises a presence of a particular color indicating wear of a coating on the outer surface of the reciprocating element or wear of a coating on the inner surface of the sleeve.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: R=R1+k*(Ru−R1), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A pump fluid end comprising:

a cylindrical reciprocating element disposed at least partially within a cylindrical reciprocating element bore and having an outer surface extending along a length thereof;

a reciprocating element packing positioned within the reciprocating element bore; and optionally a cylindrical sleeve positioned within the reciprocating element bore such that the reciprocating element reciprocates within the sleeve and having an inner surface proximate the outer surface of the reciprocating element, wherein at least a portion of the outer surface extending along the length of the reciprocating element is coated with a multi-layer surface coating comprising a plurality of layers including:

a first layer in contact with the at least a portion of the outer surface of the reciprocating element; and a second layer disposed over at least a portion of the first layer; and wherein at least one of the plurality of layers has a different visual appearance than at least one other of the plurality of layers, and wherein an initial thickness of each layer of the plurality of layers indicates a specific level of wear of the reciprocating element packing and/or the coated reciprocating element, such that visual examination of the coated reciprocating element disposed at least partially within the cylindrical reciprocating element bore can be utilized to determine a level of wear of the reciprocating element packing and/or the coated reciprocating element resulting from operation of the pump fluid end.

2. The pump fluid end of claim 1, wherein the multilayer surface coating consists of the first layer and the second layer, and wherein the first layer further has a different material composition than the second layer.

3. The pump fluid end of claim 2, wherein a color of the second layer is different from a color of the first layer.

4. The pump fluid end of claim 3, wherein the color of the first layer is yellow.

5. The pump fluid end of claim 1, wherein the multilayer surface coating further comprises a third layer.

6. The pump fluid end of claim 1, wherein the first layer, the second layer, each of the plurality of layers, and/or the multilayer surface coating has a thickness of less than or equal to about 0.04 inch (1016 μm).

7. The pump fluid end of claim 1, wherein the entire outer surface of the reciprocating element comprises the multilayer surface coating.

8. The pump fluid end of claim 1, comprising the cylindrical sleeve, wherein least a portion of the inner surface of the cylindrical sleeve also comprises the multilayer surface coating.

9. The pump fluid end of claim 1, wherein the first layer comprises a nickel-based spray layer, iron particles, an aluminum bronze layer, or a combination thereof.

10. The pump fluid end of claim 9, wherein the second layer comprises titanium, ceramic alumina, a nickel-based spray, iron particles, or a combination thereof that is different from the first layer.

11. The pump fluid end of claim 1, wherein an initial thickness of the second layer is equal to a maximum wear allowance of the packing and/or the coated reciprocating element.

12. The pump fluid end of claim 1, wherein the first layer and/or the second layer independently comprises a high velocity oxygen fuel (HVOF) layer, a combustion flame spray layer, a plasma spray layer, a vacuum plasma spray layer, a two wire electric arc spray layer, or a combination thereof.

13. The pump fluid end of claim 1, wherein each layer of the plurality of layers independently comprises a nickel-based spray layer, a titanium nitride layer, a ceramic alumina layer, an alumina bronze layer, or a combination thereof.

14. A method of servicing a wellbore, the method comprising:

fluidly coupling a pump to a source of a wellbore servicing fluid and to the wellbore; and communicating a wellbore servicing fluid into the wellbore via the pump, wherein the pump comprises:

a pump fluid end and a pump power end, wherein the pump power end is operable to reciprocate a cylindrical reciprocating element within a cylindrical reciprocating element bore of the pump fluid end, and wherein the pump fluid end comprises: the reciprocating element disposed at least partially within the reciprocating element bore and having an outer surface extending along a length thereof;

a reciprocating element packing positioned at a back of the pump fluid end within the reciprocating element bore; and optionally a sleeve positioned within the reciprocating element bore such that the reciprocating element reciprocates within the sleeve and having an inner surface proximate the outer surface of the reciprocating element, wherein at least a portion of the outer surface extending along the length of the reciprocating element comprises a multi-layer surface coating and the reciprocating element is a coated reciprocating element, wherein the multi-layer surface coating comprises a plurality of layers including: a first layer in contact with the at least a portion of the outer surface of the reciprocating element; and a second layer disposed over at least a portion of the first layer; and wherein at least one of the plurality of layers has a different visual appearance than at least one other of the plurality of layers, and wherein an initial thickness of each layer of the plurality of layers indicates a specific level of wear of the reciprocating element packing and/or the coated reciprocating element, such that visual examination of the coated reciprocating element disposed at least partially within the cylindrical reciprocating element bore can be utilized to determine a level of wear of the reciprocating element packing and/or the coated reciprocating element resulting from operation of the pump fluid end.

15. The method of claim 14 further comprising:

discontinuing the communicating of the wellbore servicing fluid into the wellbore via the pump;

examining the coated reciprocating element disposed at least partially within the cylindrical reciprocating element bore to ascertain a wear level of the reciprocating element packing and/or the coated reciprocating element based on a visual appearance of the coated reciprocating element;

optionally subjecting the pump to maintenance to provide a maintained pump, wherein the maintenance comprises repairing or replacing the reciprocating element packing, the reciprocating element, and/or the cylindrical sleeve; and communicating the or another wellbore servicing fluid into the wellbore via the pump or the maintained pump.

16. The method of claim 15, wherein the wellbore servicing fluid, the another wellbore servicing fluid, or both the wellbore servicing fluid and the another wellbore servicing fluid comprise a fracturing fluid, a cementitious fluid, a remedial fluid, a perforating fluid, a sealant, a drilling fluid, a spacer fluid, a completion fluid, a gravel pack fluid, a gelation fluid, a polymeric fluid, an aqueous fluid, an oleaginous fluid, or a combination thereof.

17. The method of claim 15, wherein the pump or the maintained pump operates during the pumping of the wellbore servicing fluid or the another wellbore servicing fluid at a pressure of greater than or equal to about 3,000 psi, 5,000 psi, 10,000 psi, 20,000 psi, 30,000 psi, 40,000 psi, or 50,000 psi.

18. The method of claim 15 wherein the pump or the maintained pump operates during the pumping of the wellbore servicing fluid or the another wellbore servicing fluid at a volumetric flow rate of greater than or equal to about 3, 10, or 20 barrels per minute (BPM), or in a range of from about 3 to about 20, from about 10 to about 20, or from about 5 to about 20 BPM.

19. A method of indicating the wear level of a reciprocating element packing of a pump, the method comprising:

coating at least a portion of an outer surface extending along a length of a cylindrical reciprocating element with a multi-layer surface coating comprising a plurality of layers by:

disposing a first layer in contact with the at least a portion of the outer surface extending along the length of the reciprocating element to provide a coated reciprocating element; and disposing a second layer over at least a portion of the first layer, wherein at least one of the plurality of layers has a different visual appearance than at least one other of the plurality of layers, and wherein a thickness of each of the plurality of layers correlates with a level of wear of the reciprocating element packing and/or the coated reciprocating element.

20. The method of claim 19, wherein disposing the first layer and/or disposing the second layer comprises disposing via: high velocity oxygen fuel (HVOF), combustion flame spraying, plasma spraying, vacuum plasma spraying, two-wire electric arc spraying, or a combination thereof.

21. The pump fluid end of claim 1, wherein a thickness of the first layer is selected to indicate a need for repair or replacement of the packing and/or the coated reciprocating element when the examination of the reciprocating element packing and/or the coated reciprocating element indicates that the first layer is exposed.

22. The pump fluid end of claim 1, wherein examination further comprises ultrasonic inspection, magnetic field detection, eddy current, liquid penetrant, or a combination thereof.

* * * * *